US009801463B1

(12) United States Patent
Brandenberg

(10) Patent No.: US 9,801,463 B1
(45) Date of Patent: Oct. 31, 2017

(54) FURNITURE ARTICLE WITH CONCEALED STORAGE AND A REMOVABLE TOP

(71) Applicant: Carl Brock Brandenberg, Fort Worth, TX (US)

(72) Inventor: Carl Brock Brandenberg, Fort Worth, TX (US)

( * ) Notice: Subject to any disclaimer, the term of this patent is extended or adjusted under 35 U.S.C. 154(b) by 0 days.

(21) Appl. No.: 15/242,695

(22) Filed: Aug. 22, 2016

Related U.S. Application Data

(63) Continuation of application No. 14/448,773, filed on Jul. 31, 2014, now Pat. No. 9,420,879.

(51) Int. Cl.

| | |
|---|---|
| ***A47B 47/00*** | (2006.01) |
| ***A47B 67/00*** | (2006.01) |
| ***A47B 13/08*** | (2006.01) |
| ***A47B 96/20*** | (2006.01) |
| ***A47B 83/04*** | (2006.01) |

(52) U.S. Cl.
CPC ..... *A47B 47/0025* (2013.01); *A47B 13/08* (2013.01); *A47B 47/0091* (2013.01); *A47B 67/00* (2013.01); *A47B 83/045* (2013.01); *A47B 96/201* (2013.01)

(58) Field of Classification Search
CPC . A47B 47/00; A47B 47/0025; A47B 47/0075; A47B 47/042; A47B 47/00911; A47B 3/00; A47B 3/06; A47B 3/12; A47B 39/04; A47B 25/00
See application file for complete search history.

(56) References Cited

U.S. PATENT DOCUMENTS

| | | | | |
|---|---|---|---|---|
| 5,244,271 | A * | 9/1993 | Hackwood | A47B 13/021 108/156 |
| 5,327,838 | A * | 7/1994 | Beltman | A47B 25/00 108/25 |
| 6,003,963 | A * | 12/1999 | Grender | A47B 85/06 108/167 |
| 6,361,133 | B1 * | 3/2002 | Carr | E04H 5/04 248/346.01 |
| 6,766,747 | B1 * | 7/2004 | Wolfe | A47B 13/081 108/26 |
| 7,510,479 | B2 * | 3/2009 | Stengel | A63H 33/32 108/25 |
| 8,621,739 | B1 | 1/2014 | Elliot | |
| 2003/0205180 | A1 | 11/2003 | Bishop | |
| 2009/0066140 | A1 | 3/2009 | Berent et al. | |
| 2010/0093257 | A1 | 4/2010 | Elliott | |

(Continued)

OTHER PUBLICATIONS

Webpage "Coaster Hone Furnishings 800118 Contemporary Computer Desk" http://www.amazon.com/Coaster-Home-Furnishings-800118-Contemporary/dp/BOOFPGXGM8.

(Continued)

*Primary Examiner* — Daniel Rohrhoff
(74) *Attorney, Agent, or Firm* — James E. Walton

(57) ABSTRACT

The present application relates to snap-together or press-together furniture. In a preferred embodiment, a table is provided that can be packaged and transported in a compact disassembled state, then easily assembled by the user without need for tools or hardware. Further, the table may be subsequently disassembled and re-assembled by the user as desired without need for tools or hardware.

17 Claims, 31 Drawing Sheets

(56) References Cited

U.S. PATENT DOCUMENTS

| | | | | |
|---|---|---|---|---|
| 2013/0264847 | A1* | 10/2013 | Pugh | A47B 3/06 297/135 |
| 2014/0373357 | A1 | 12/2014 | Elliott | |
| 2016/0174700 | A1* | 6/2016 | Brandenberg | A47B 47/04 5/93.1 |

OTHER PUBLICATIONS

Webpage "Wooden Lego Table" http://www.ebay.com/itm/A-Table-for-Legos-with-Fold-Out-Legs-Lap-or-Flat-Table-Pine-Wood-2-Bases-92-/191617706025.
Webpage Marijn Dionys "Niks Ann De Hand!" http://naai-s.blogspot.be/2014/07/niks-aan-de-hand.html.
Webpage "chamber desk" http://www.cb2.com/chamber-desk/s672395 Jun. 3, 2014.
Webpage "EP30 The Flip Desk" http://homemade-modern.corn/ep30-the-flip-desk/ Mar. 17, 2014.
Webpage "Hollow Core Connect IT" http://www.amazon.com/Monarch-Specialties-Hollow-Connect-It-48-Inch/dp/B008V6SZH0.
Webpage SIMON "Slope Desk by Jenk Design Office" http://www.betterlivingthroughdesign.com/furnishings/slope-desk-by-jenk-design-office/ May 31, 2011.
Webpage KATIE "Flip Table by No Problem" http://www.betterlivingthroughdesign.com/furnishings/flip-table-by-no-problem/ Oct. 1, 2010.

* cited by examiner

MIDDLE FINGER-THUMB GRIP LENGTH

Subject grasps the pointed blades of an automated sliding caliper with right hand. Measure the distance between the middle phalanges of the middle finger and thumb keeping the middle phalanges of these digits parallel.

MIDDLE FINGER-THUMB GRIP LENGTH (cm)
(Males and Females)

| Age (yrs) | N | Mean | s.d. | Min | 5th | 50th | 95th | Max |
|---|---|---|---|---|---|---|---|---|
| 2.0-3.5 | 64 | 6.0 | 0.8 | 4.3 | 4.5 | 5.9 | 7.2 | 7.9 |
| 3.5-4.5 | 63 | 6.2 | 1.0 | 3.9 | 4.1 | 6.3 | 7.7 | 8.5 |
| 4.5-5.5 | 90 | 6.4 | 0.8 | 3.6 | 4.7 | 6.5 | 7.5 | 8.0 |
| 5.5-6.5 | 61 | 7.0 | 1.0 | 4.4 | 5.0 | 7.0 | 8.4 | 9.0 |
| 6.5-7.5 | 62 | 7.5 | 1.0 | 4.4 | 4.9 | 7.6 | 8.6 | 8.9 |
| 7.5-8.5 | 59 | 7.6 | 1.1 | 5.2 | 5.4 | 7.8 | 9.1 | 9.7 |
| 8.5-9.5 | 78 | 8.1 | 0.9 | 4.9 | 6.5 | 8.1 | 9.5 | 9.7 |
| 9.5-10.5 | 92 | 8.5 | 1.1 | 6.0 | 6.4 | 8.4 | 10.1 | 11.1 |
| 10.5-11.5 | 98 | 8.9 | 1.1 | 5.8 | 6.6 | 8.9 | 10.6 | 11.7 |
| 11.5-12.5 | 94 | 9.1 | 1.1 | 5.1 | 6.9 | 9.2 | 10.7 | 11.3 |
| 12.5-13.5 | 107 | 9.5 | 1.0 | 6.5 | 7.6 | 9.5 | 11.2 | 11.9 |
| 13.5-14.5 | 97 | 9.4 | 1.2 | 5.8 | 7.1 | 9.5 | 11.2 | 12.7 |
| 14.5-15.5 | 95 | 10.2 | 1.0 | 6.5 | 8.4 | 10.2 | 11.9 | 12.8 |
| 15.5-16.5 | 56 | 10.1 | 1.1 | 6.3 | 8.3 | 10.1 | 11.5 | 12.0 |
| 16.5-17.5 | 80 | 10.0 | 1.2 | 5.0 | 7.6 | 10.0 | 11.6 | 12.3 |
| 17.5-19.0 | 45 | 10.3 | 1.1 | 5.9 | 8.5 | 10.2 | 11.7 | 11.9 |

MIDDLE FINGER-THUMB GRIP LENGTH (cm)
(Males)

| Age (yrs) | N | Mean | s.d. | Min | 5th | 50th | 95th | Max |
|---|---|---|---|---|---|---|---|---|
| 2.0-3.5 | 36 | 5.8 | 0.8 | 4.3 | 4.4 | 5.6 | 7.3 | 7.9 |
| 3.5-4.5 | 32 | 6.1 | 1.1 | 3.9 | 4.0 | 6.2 | 7.9 | 8.5 |
| 4.5-5.5 | 50 | 6.4 | 0.8 | 3.6 | 4.6 | 6.5 | 7.4 | 7.9 |
| 5.5-6.5 | 25 | 6.6 | 1.0 | 4.4 | 4.4 | 6.4 | 7.9 | 8.1 |
| 6.5-7.5 | 29 | 7.2 | 1.1 | 4.4 | 4.6 | 7.3 | 8.7 | 8.9 |
| 7.5-8.5 | 29 | 7.4 | 1.1 | 5.2 | 5.2 | 7.6 | 8.9 | 9.7 |
| 8.5-9.5 | 39 | 8.0 | 0.9 | 5.8 | 6.4 | 8.0 | 9.3 | 9.6 |
| 9.5-10.5 | 47 | 8.2 | 1.0 | 6.3 | 6.3 | 8.3 | 9.5 | 10.5 |
| 10.5-11.5 | 52 | 8.6 | 0.9 | 6.1 | 6.5 | 8.5 | 9.7 | 10.1 |
| 11.5-12.5 | 46 | 8.9 | 1.2 | 5.1 | 6.0 | 9.1 | 10.4 | 10.8 |
| 12.5-13.5 | 46 | 9.4 | 0.9 | 6.5 | 7.4 | 9.4 | 10.4 | 11.8 |
| 13.5-14.5 | 53 | 9.4 | 1.0 | 7.0 | 7.2 | 9.4 | 10.8 | 12.3 |
| 14.5-15.5 | 50 | 10.3 | 1.0 | 8.0 | 8.4 | 10.4 | 12.0 | 12.4 |
| 15.5-16.5 | 31 | 10.3 | 1.0 | 8.2 | 8.3 | 10.3 | 11.6 | 12.0 |
| 16.5-17.5 | 38 | 10.3 | 1.1 | 7.6 | 7.8 | 10.3 | 11.8 | 12.3 |
| 17.5-19.0 | 26 | 10.5 | 0.9 | 8.7 | 8.9 | 10.3 | 11.7 | 11.9 |

MIDDLE FINGER-THUMB GRIP LENGTH (cm)
(Females)

| Age (yrs) | N | Mean | s.d. | Min | 5th | 50th | 95th | Max |
|---|---|---|---|---|---|---|---|---|
| 2.0-3.5 | 28 | 6.2 | 0.7 | 4.5 | 4.7 | 6.3 | 7.1 | 7.2 |
| 3.5-4.5 | 31 | 6.2 | 1.0 | 4.1 | 4.3 | 6.3 | 7.6 | 7.8 |
| 4.5-5.5 | 40 | 6.4 | 0.9 | 4.8 | 4.8 | 6.4 | 7.4 | 8.0 |
| 5.5-6.5 | 36 | 7.3 | 0.9 | 5.2 | 5.2 | 7.2 | 8.7 | 9.0 |
| 6.5-7.5 | 33 | 7.6 | 0.8 | 4.6 | 5.7 | 7.7 | 8.5 | 8.9 |
| 7.5-8.5 | 30 | 7.9 | 0.9 | 5.4 | 5.5 | 7.8 | 9.1 | 9.6 |
| 8.5-9.5 | 39 | 8.2 | 0.9 | 4.9 | 6.7 | 8.2 | 9.5 | 9.7 |
| 9.5-10.5 | 45 | 8.7 | 1.1 | 6.0 | 6.4 | 8.8 | 10.2 | 11.1 |
| 10.5-11.5 | 46 | 9.2 | 1.3 | 5.8 | 6.7 | 9.4 | 11.0 | 11.7 |
| 11.5-12.5 | 48 | 9.2 | 1.1 | 6.6 | 7.2 | 9.2 | 10.9 | 11.3 |
| 12.5-13.5 | 61 | 9.6 | 1.1 | 7.0 | 7.5 | 9.6 | 11.4 | 11.9 |
| 13.5-14.5 | 44 | 9.4 | 1.4 | 5.8 | 6.4 | 9.5 | 11.2 | 12.7 |
| 14.5-15.5 | 45 | 10.0 | 1.1 | 6.5 | 7.9 | 10.0 | 11.4 | 12.8 |
| 15.5-16.5 | 25 | 9.9 | 1.1 | 6.3 | 6.8 | 9.7 | 11.4 | 11.9 |
| 16.5-17.5 | 42 | 9.6 | 1.3 | 5.0 | 6.2 | 9.6 | 11.3 | 11.5 |
| 17.5-19.0 | 19 | 10.1 | 1.3 | 5.9 | ** | 10.2 | ** | 11.8 |

FIG 22

FURNITURE ARTICLE WITH CONCEALED STORAGE AND A REMOVABLE TOP

CROSS REFERENCE TO RELATED APPLICATIONS

This application is a continuation of U.S. application Ser. No. 14/448,773, filed 31 Jul. 2014, titled "Furniture Article with Concealed Storage and A Removable Top," which issued on 23 Aug. 2016 under U.S. Pat. No. 9,420,879, all of which are hereby incorporated by reference for all purposes as if fully set forth herein.

BACKGROUND

1. Field of the Application

The present application relates to furniture with integral storage.

2. Description of Related Art

Furniture with integral storage has been around for many decades. Many of these types of furniture also include removable components, such as drawers and shelves.

Although great strides have been made in the area of furniture with integral storage, many shortcomings remain.

BRIEF DESCRIPTION OF THE DRAWINGS

FIG. 22—Child anthropometry data used for designing small top panel cutouts.

DETAILED DESCRIPTION OF THE PREFERRED EMBODIMENT

Introduction

The device of the present application is an article of furniture which provides a concealed storage volume or compartment with easily movable panels which cover the storage compartment and which may be selectively moved to reveal some or all of the storage compartment underneath.

The preferred embodiment is a table that can be packaged and transported in a compact disassembled state, then easily assembled by the user without need for tools or hardware. Further, the table may be subsequently disassembled and re-assembled by the user as desired without need for tools or hardware.

An alternate embodiment is a table that can be packaged and transported in a compact disassembled state, then easily assembled by the user with the aid of hardware and/or tools.

It should be understood that an alternate embodiment could be an article of furniture that is already assembled, having been fabricated using traditional furniture manufacturing techniques, or that is already pre-assembled for the user.

Scalable Design:

The preferred embodiment may be used in any number of environments, from home living rooms to child playrooms to office waiting rooms to provide easily accessible storage for small items such as building blocks, toys or even electronics such as tablets and hand-held game machines and controllers. It should be anticipated that the device of the present application may be scaled in any dimension to optimize the design for a particular environment or to produce embodiments for environments not discussed herein.

Figure 1:
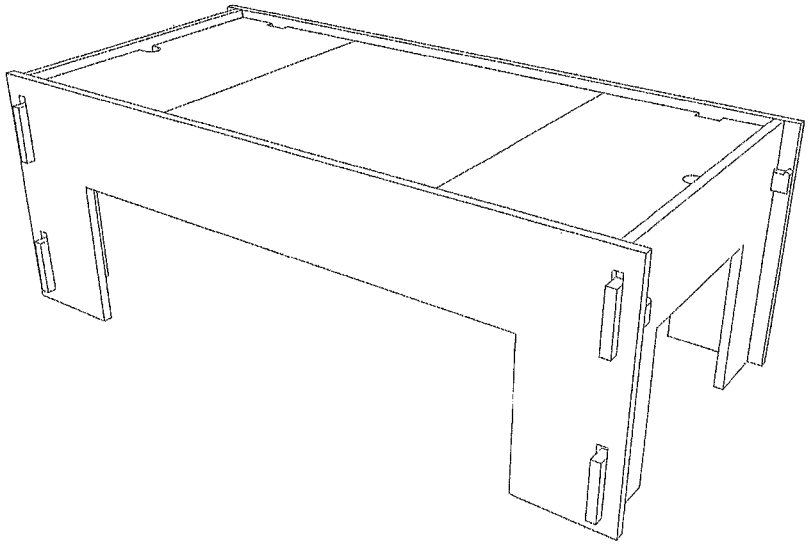
FIG. 1—Assembled table design with storage volume located under three removable top panels.

The preferred embodiment shown in FIG. 1 has a size and proportions suitable for use as a coffee table in a home living room or play table in a child's playroom or doctor's waiting room.

In an alternate embodiment, the device of the present application could be scaled to produce a taller play table for standing use by older children or could be scaled to produce a work table for standing use by adults.

In an alternate embodiment as shown in FIGS. 2-15, the device of the present invention has an additional storage area underneath to allow additional storage of items such as magazines, books or even assembled building block sets. This embodiment has a size and proportions suitable for use as a table in front of a couch or sofa in a home living room.

Figure 25:
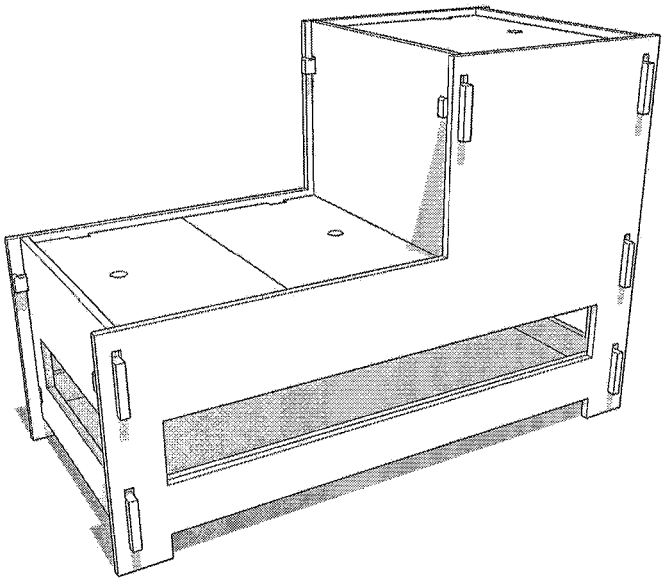
FIG. 25—View of asymmetric design embodiment.
Figure 26:
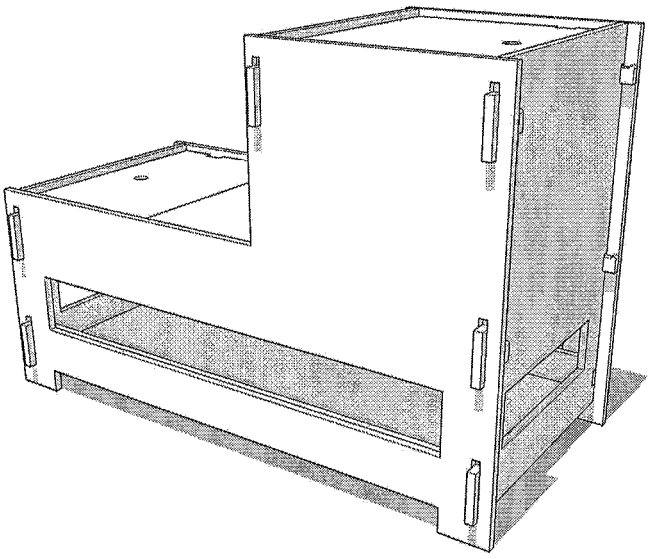
FIG. 26—Alternate view of asymmetric design embodiment.

In an alternate embodiment as shown in FIGS. 25-26, the device of the present invention has an asymmetric design with surfaces at appropriate heights for two different age ranges, one side being lower at which younger children could stand and play and one side being taller at which older children could stand and play.

In an alternate embodiment, the device of the present application could be scaled to produce a wider and/or longer play table for use with toys such as electric train sets or electric slot car tracks that take up a larger area when the tracks are assembled into a complete railroad or racing circuit.

In an alternate embodiment, the device of the present application could be scaled to produce a workbench or tool bench with a storage compartment for holding items such as tools, hardware and supplies.

Figure 27:
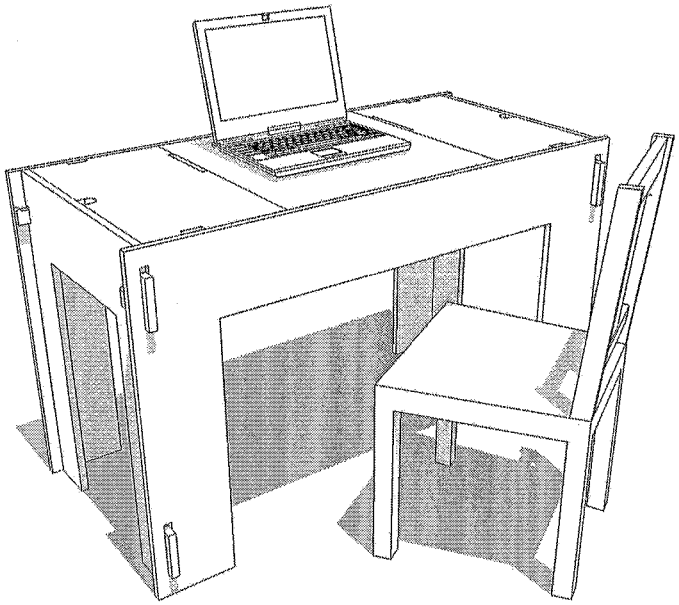
FIG. 27—View of desk embodiment.
Figure 28:
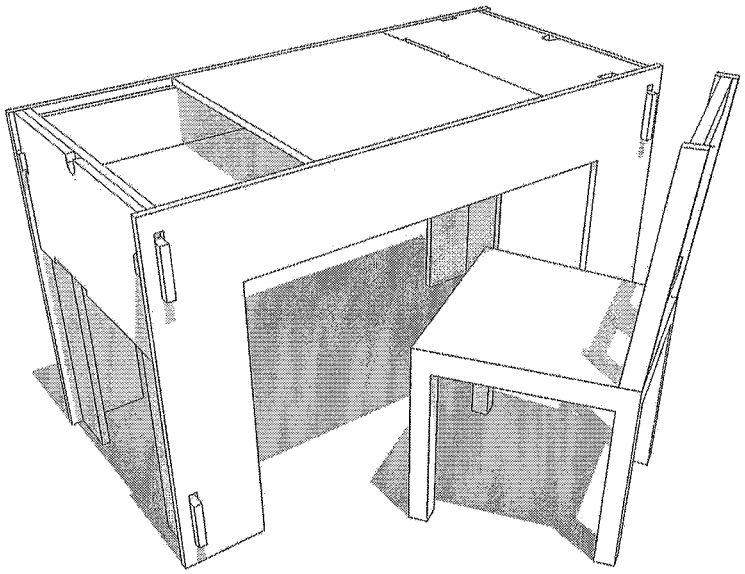
FIG. 28—Alternate view of desk embodiment with one small top panel removed and stored on the side of the desk.
Figure 29:
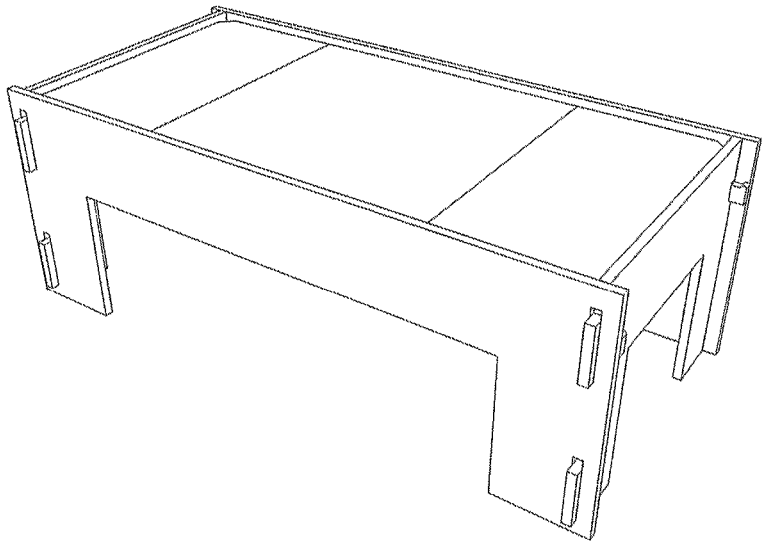
FIG. 29—Alternate embodiment illustrating three hinged top panels.
Figure 30:
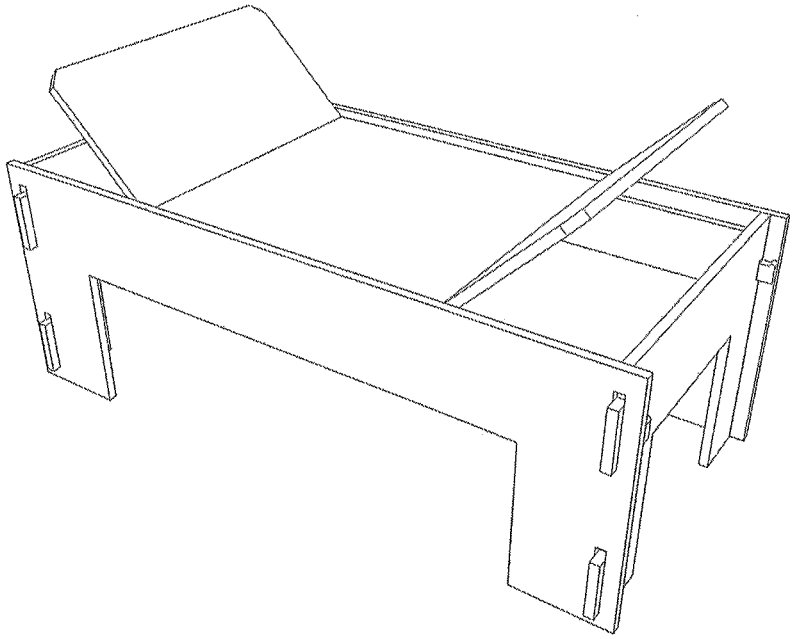
FIG. 30—Table design of FIG. 29 with small top panels being hinged open 45 degrees.
Figure 31:
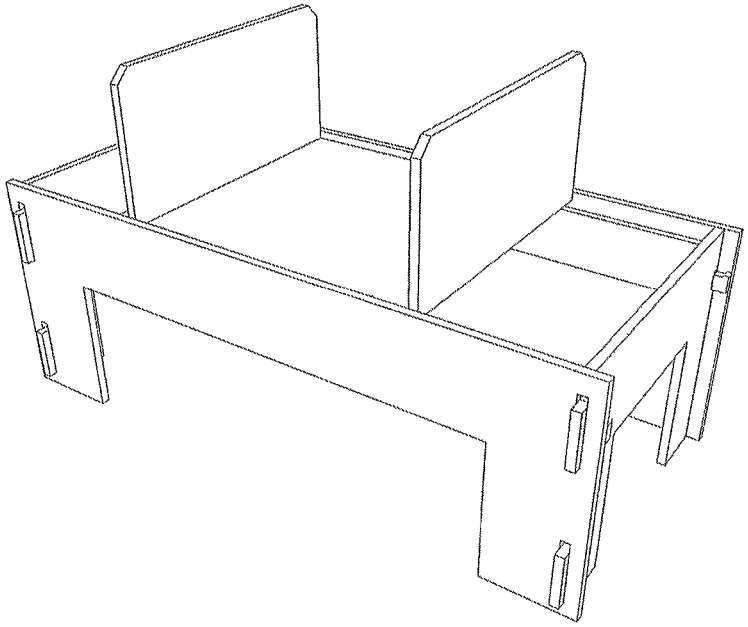
FIG. 31—Table design of FIG. 29 with small top panels being hinged open 90 degrees.
Figure 32:
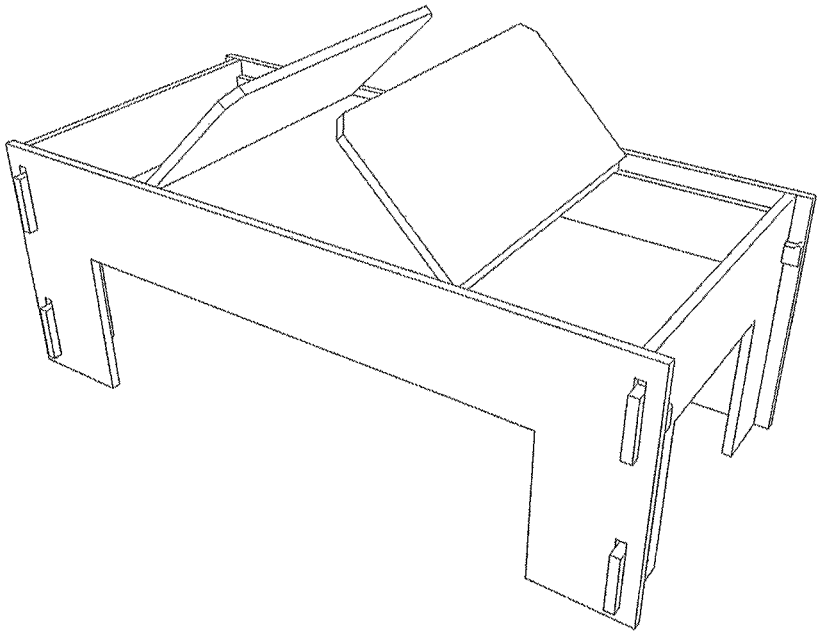
FIG. 32—Table design of FIG. 29 with small top panels being hinged open 135 degrees.
Figure 33:
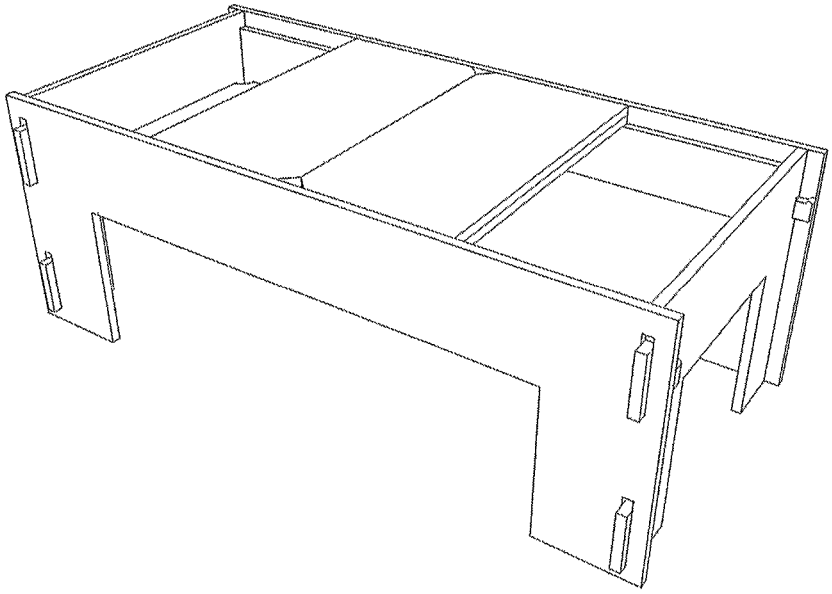
FIG. 33—Table design of FIG. 29 with small top panels hinged open fully 180 degrees.

In an alternate embodiment, the device of the present application could be scaled to produce a desk as shown in FIGS. 27-28 for use in a home or small office environment, the desk having a storage compartment for concealing items such as wiring, cables, computer accessories, books and office supplies.

Figure 41:
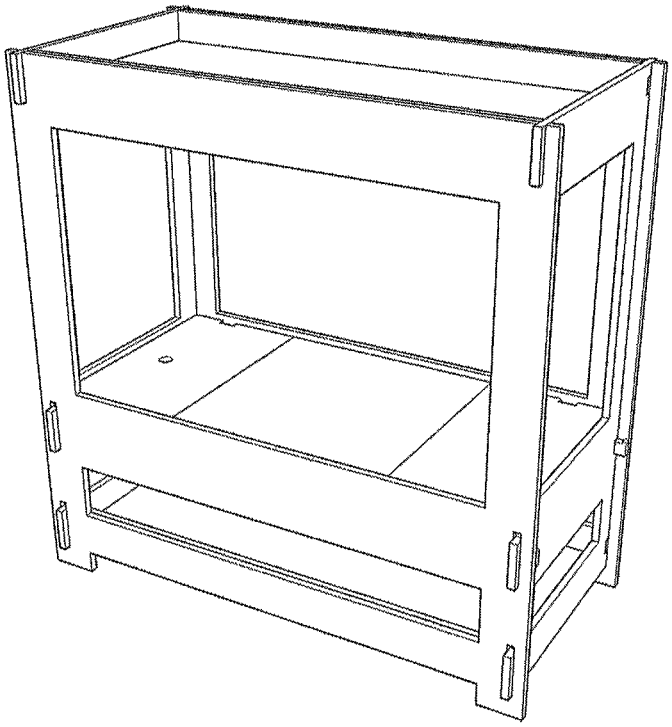
FIG. 41—Alternate embodiment with additional storage areas above and below.

Multiple Storage Areas:

It should be anticipated that the device of the present application could have additional embodiments that provide additional storage areas and/or additional storage volumes above and/or below the primary storage volume. FIGS. 2-13 illustrate an alternate embodiment with a storage volume on top and an additional storage area below. An alternate embodiment as shown in FIG. 41 could be a tall design with additional storage areas above and below the storage volume, providing additional storage for items like books, assembled Lego sets or stuffed toys.

Cover Panels:

In the device of the present application shown in FIG. 1, the storage volume is covered with three separate panels. These panels can be individually and selectively removed to provide access to the volume beneath. FIG. 1 shows two small panels and one large panel. The top panels may be installed in any configuration, but they are shown with the large panel located in the middle with each of the small panels on either side. Alternate embodiments of the device of the present application could incorporate fewer or more panels, or combinations of panels with hinges that join adjacent panels as shown in FIGS. 29-40 that allow a panel to fold back and store on top of an adjacent panel, providing access to the storage volume underneath.

In the device of the present application, the use of three separate top panels as shown in FIG. 1 allows two of the panels to be smaller than the third, making the small panels lighter and easier for small children to lift and remove one or both of the small panels to gain access to the toys and/or building blocks stored in the storage volume underneath. In addition, the dimensions of the small panels allows the small panels to be proportioned such that when stored, they do not exceed the dimensions of the table along which they are stored, preventing any part of the panels from protruding beyond the boundaries of the table.

When a top panel is removed, children may play from the adjacent sides of the table with unimpeded access to the storage area. Because the top panels may be removed and stored completely out of the way, there are no obstacles such as extended drawers on tables with built-in drawers or hinged-open tops on tables such as lift-top tables to impede movement around the table or to become damaged by impact. And because the storage area now accessible, there is no need to repeatedly open drawers to access their contents and subsequently close them to allow access to the table top.

In the alternate embodiments shown in FIGS. 29-40, the top panels are hingedly attached to one another and can fold back onto one another, allowing children to play from adjacent sides with unimpeded access to the storage area. The alternate embodiments shown in FIGS. 29-40 have the advantage that it is impossible to lose a single panel or to drop a panel on the floor when opening the table because the cover panels remain attached to one another.

In the alternate embodiment shown in FIGS. 46-49, the small top panels are hingedly attached to the table and positioned so that they may be rotated through approximately 270 degrees from a closed position to an open position, also allowing children to play from adjacent sides with unimpeded access to the storage area. The embodiment shown in FIGS. 46-49 has the advantage that it is impossible to lose a hinged cover panel without disassembling the table because the cover panels remain attached to the table. It has the further advantage of eliminating the chance of dropping the panel on the floor when opening the table. It should be anticipated that the panels could be positioned and hingedly attached to different sides of the table to produce alternate embodiments with cover panels that open in various other ways.

In the preferred embodiment, the top panels are supported by two rails along opposite sides of the table. The large top panel may be square which would allow it to be installed in any orientation atop the two supporting rails. The large top panel provides a build platform for building blocks or a play area for other toys when the small panels are removed. The large top panel may slide along the supporting rails toward either side to allow access to the entire storage volume beneath. The large panel may also be removed entirely, but its sliding design allows it to remain in place and still provide access to objects and toys beneath it.

In the preferred embodiment, the rails supporting the top panels also provide a means to hide the joinery that supports the panel that forms the bottom of the storage volume. These supporting rails may contain slots that allow tabs on the mating panel to insert into the slots, as shown in the exploded views in FIGS. 11-12. These tabs do not need to protrude beyond the opposite side of the supporting rails, which allows the tab and slot to remain hidden behind the side panel of the table, as is evident in FIGS. 1-10. This serves to produce a cleaner aesthetic for a table that is constructed using tool-free joinery.

Cover Panel Hangers:

As shown in FIGS. 1-5 and FIGS. 16-17, the device of the present application incorporates hangers on the opposite sides of the table that provide support for storing the small top panels when not in use covering the storage volume. These hangers may be produced by shaping one or both ends of the rails that support the top panels and allowing these shaped ends to protrude through the orthogonal panels, thus providing a desired feature without requiring any additional hardware or pieces to do so.

Figure 44:
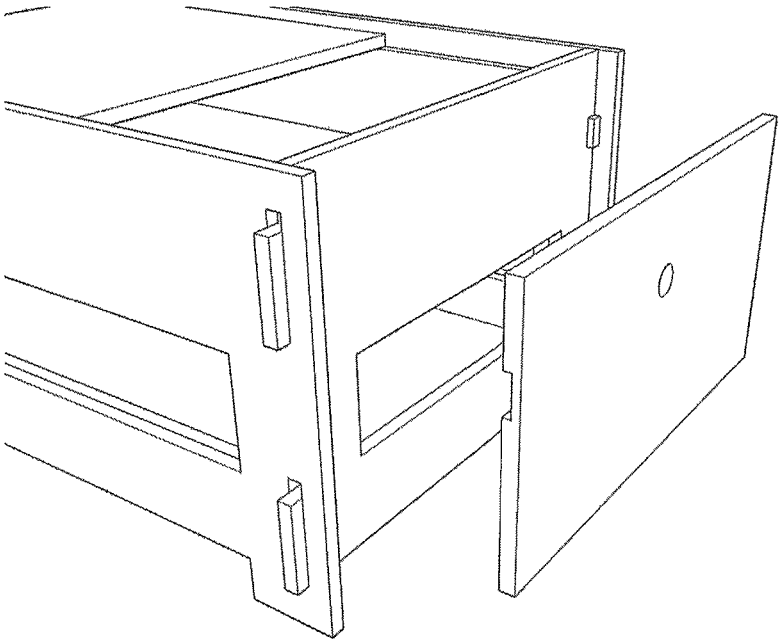
FIG. 44—Alternate embodiment illustrating blind cutout on one side of top panel.
Figure 45:
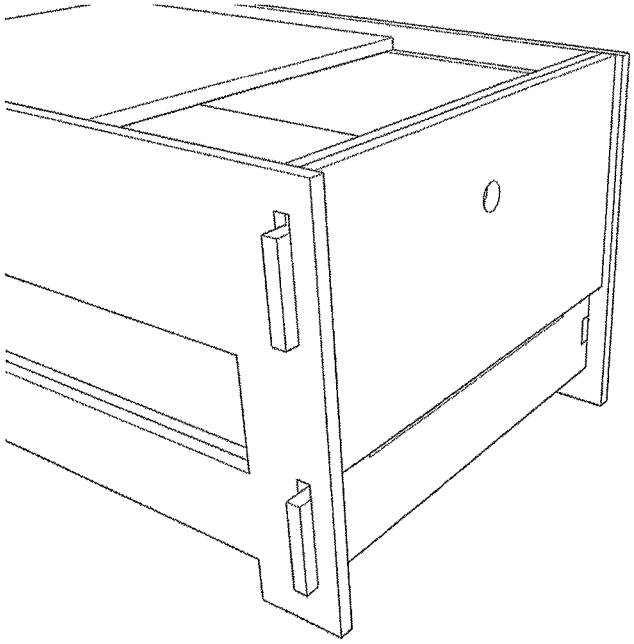
FIG. 45—Alternate embodiment illustrating blind cutout on one side of top panel.
Figure 46:
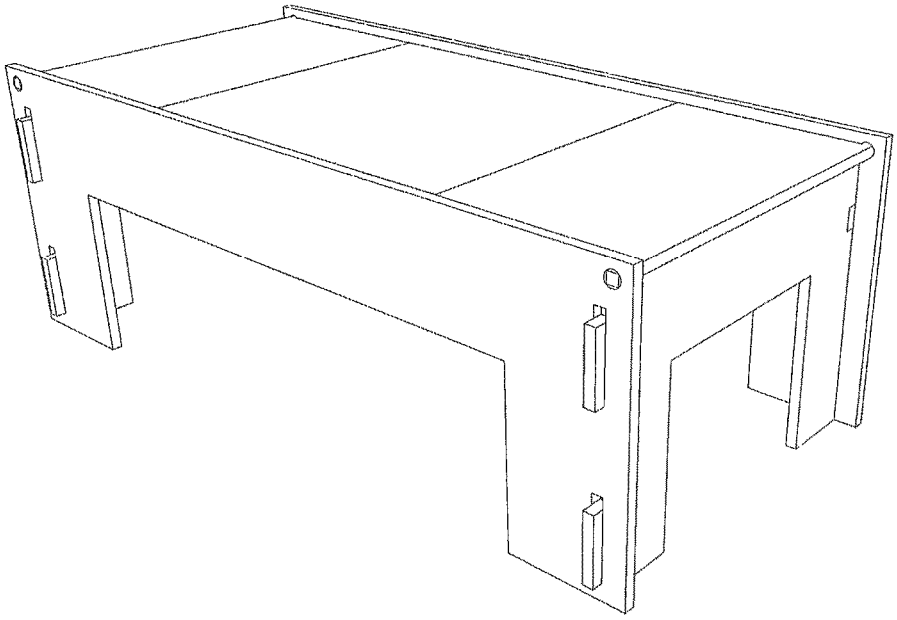
FIG. 46—Alternate embodiment illustrating hinged top panels in closed positions.
Figure 47:
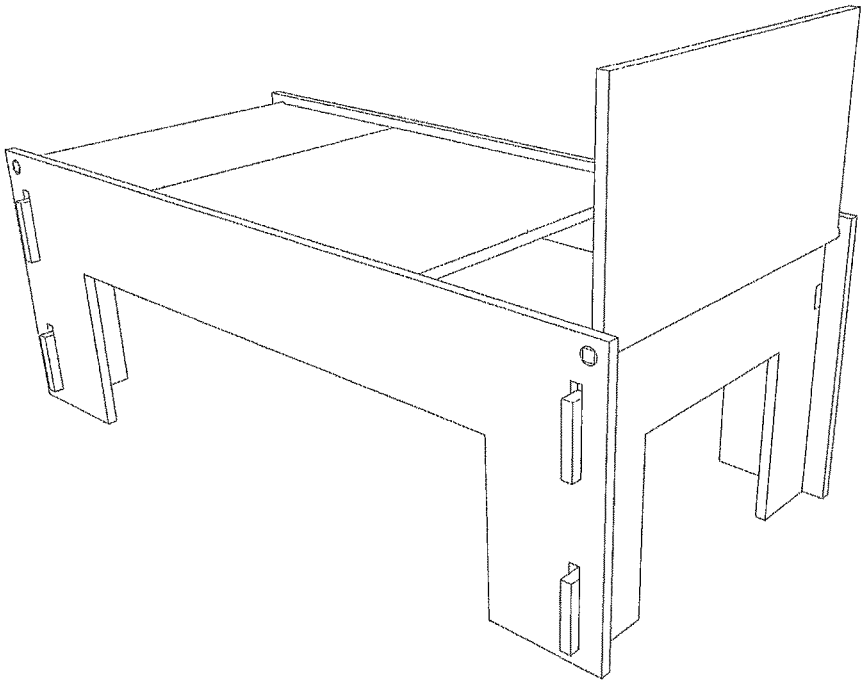
FIG. 47—Alternate embodiment of FIG. 46 with one top panel hinged open 90 degrees in a partially open position.
Figure 48:
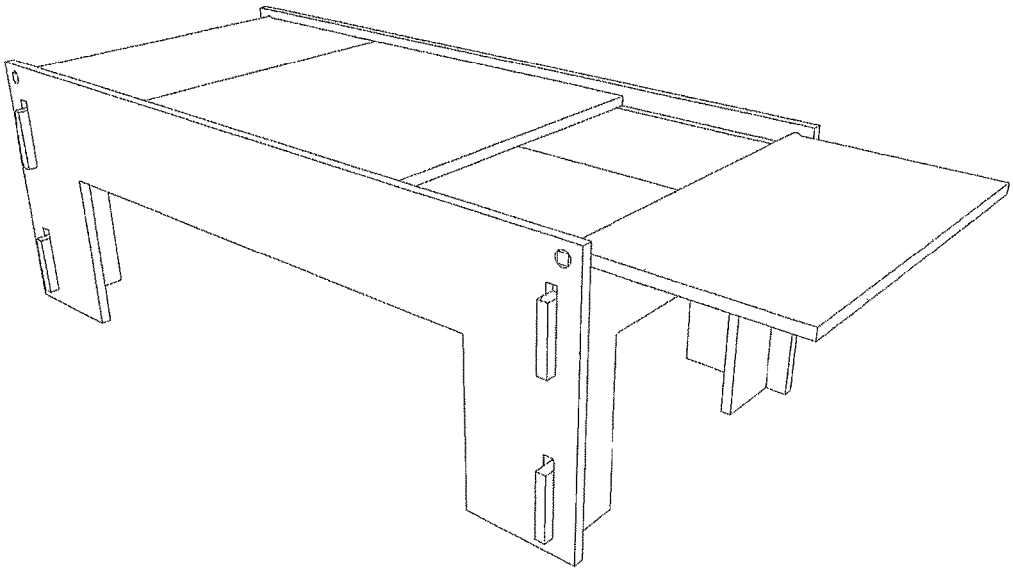
FIG. 48—Alternate embodiment of FIG. 46 with one top panel hinged open 180 degrees in a partially open position.
Figure 49:
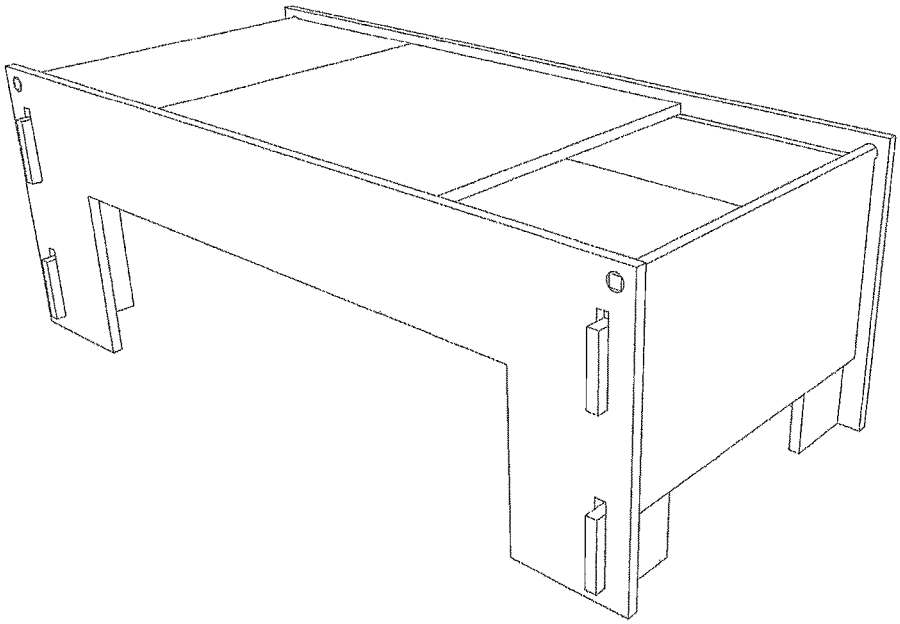
FIG. 49—Alternate embodiment of FIG. 46 with one top panel hinged open 270 degrees in the fully open position.

In an alternate embodiment, the notches necessary to hang a top panel for storage could be formed by a blind cutout on only one side of the panel as shown in FIGS. 44-45, eliminating the visible cutout through the entire thickness of the panel that can be seen in FIG. 1. These blind cutouts could be produced with a straight cutting bit, or they could be produced with a dovetail cutting bit which would produce a tapered surface that would ensure that the panel would rest on the mating hanger more securely if the mating hanger was cut with a matching profile.

Figure 42:
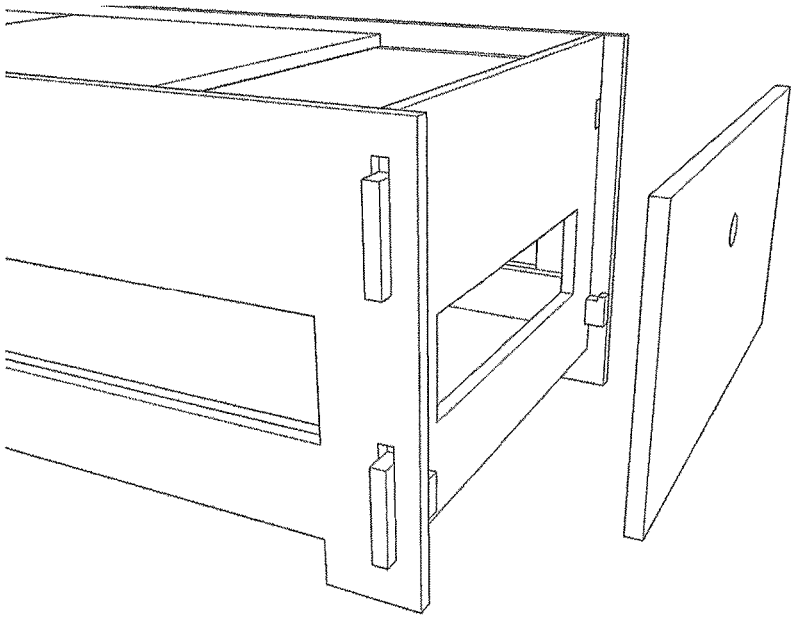
FIG. 42—Alternate embodiment illustrating panel hangers formed on lower rails.
Figure 43:
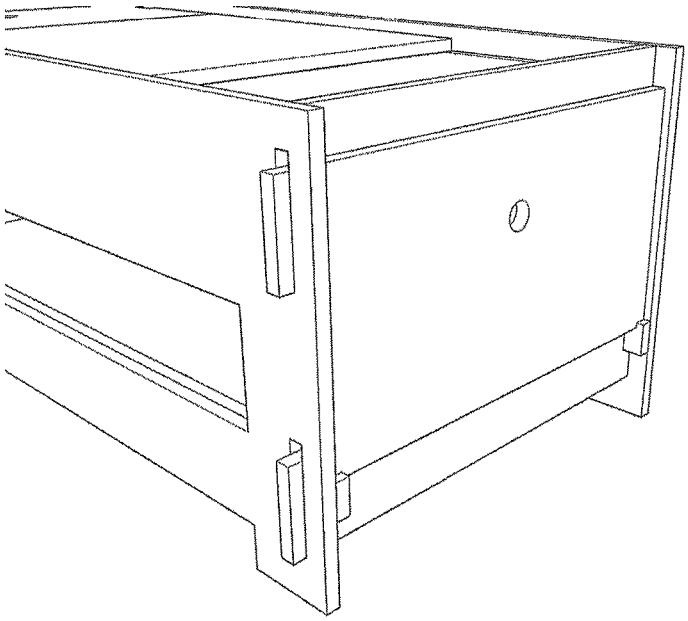
FIG. 43—Alternate embodiment illustrating panel stored on hangers on lower rails.

In an alternate embodiment, hangers could be formed on lower rails and a top panel could be stood up on the hangers instead of hanging down from the hangers, eliminating the need for notches in the top panels as shown in FIGS. 42-43.

In an alternate embodiment, hangers could be produced by attaching one or more pieces of hardware to the device, for example a metal hook permanently attached to a panel on which to hang a cover panel.

It should be anticipated that the length and location of the hangers can be varied such that removable panels may be stored all on one side or stored on multiple sides of the table in alternate embodiments.

In an alternate embodiment, the removable panels could be stored horizontally below the storage volume. In alternate embodiments where the dimensions and proportions of a cover panel exceeds the dimensions of the table and precludes storing the panel on the outside of the table, a substantially horizontal storage position below the storage volume would suffice to store the panels out of the way of the user.

Figure 18:
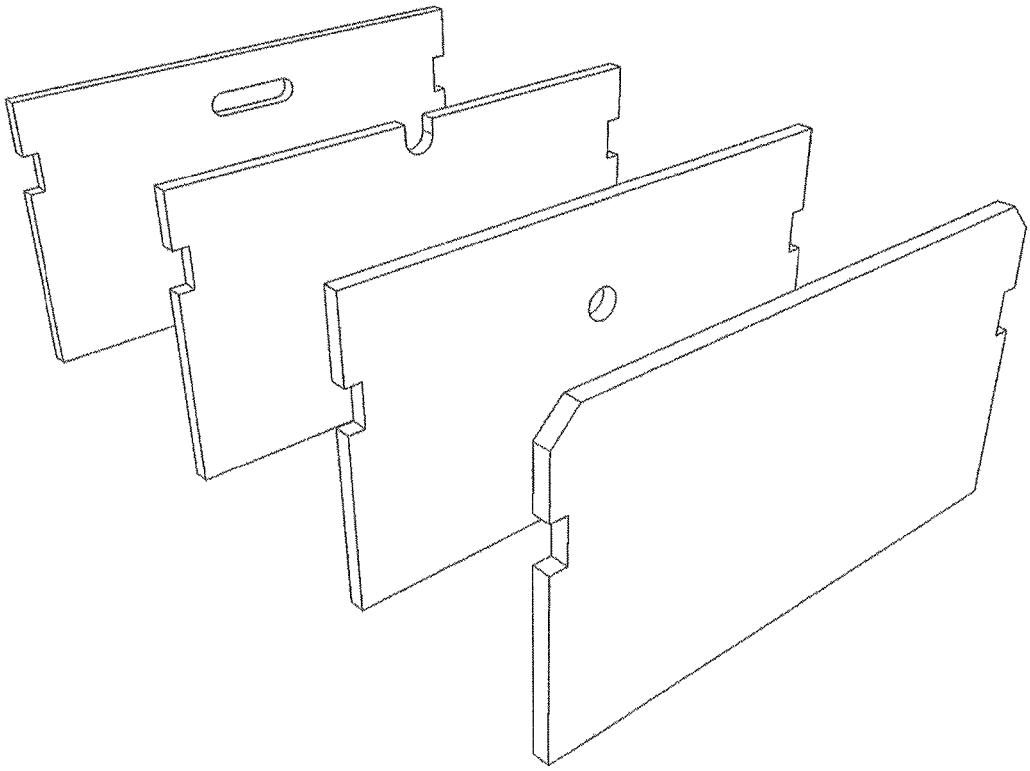
FIG. 18—Detail of a small top panel showing three alternate cutout designs.

Cover Panel Cutouts:

In the device of the present application, the top panels may incorporate openings or cutouts to facilitate easy lifting and removal by hand. These openings may consist of one or more notches formed into the perimeter of the panel as shown in FIG. 18 to allow a user to insert one or more fingers into the notch and tilt it up, allowing the user to then grasp the panel between their thumb and forefingers and remove it by lifting the panel out when not hinged to an adjacent panel. Alternately, the openings may consist of one or more holes cut within the interior of the panel as also shown in FIG. 18 to form at least one handle which allows the panel to be tilted up and grasped more securely by the handle.

Figure 19:
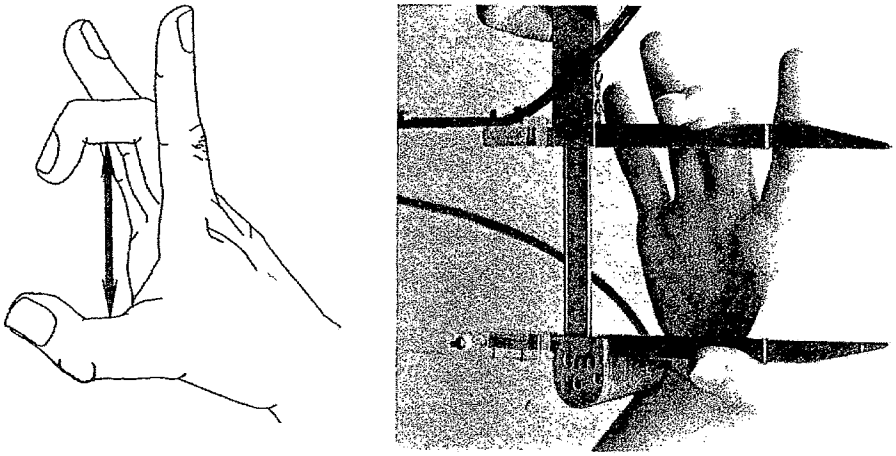
FIG. 19—Child anthropometry data used for designing small top panel cutouts.
Figure 20:
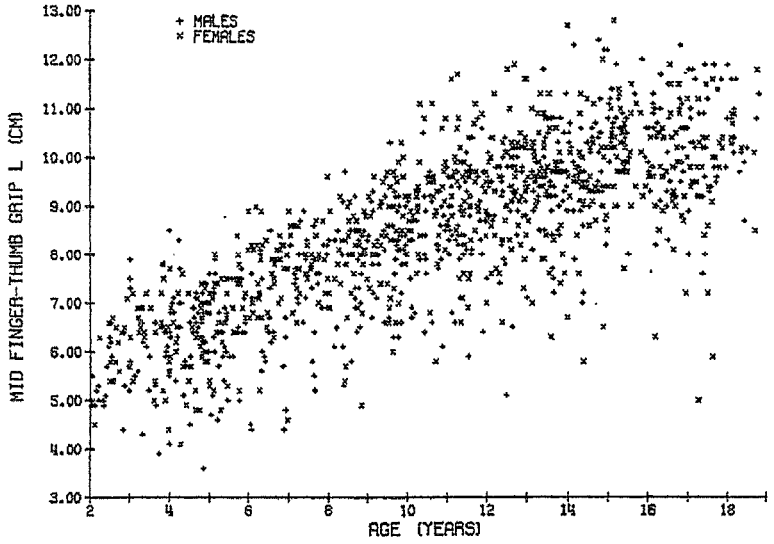
FIG. 20—Child anthropometry data used for designing small top panel cutouts.
Figure 21:
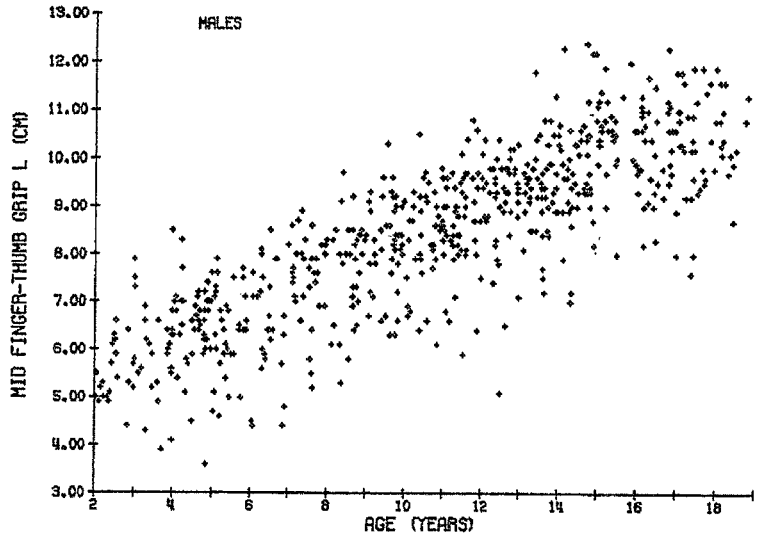
FIG. 21—Child anthropometry data used for designing small top panel cutouts.
Figure 21:
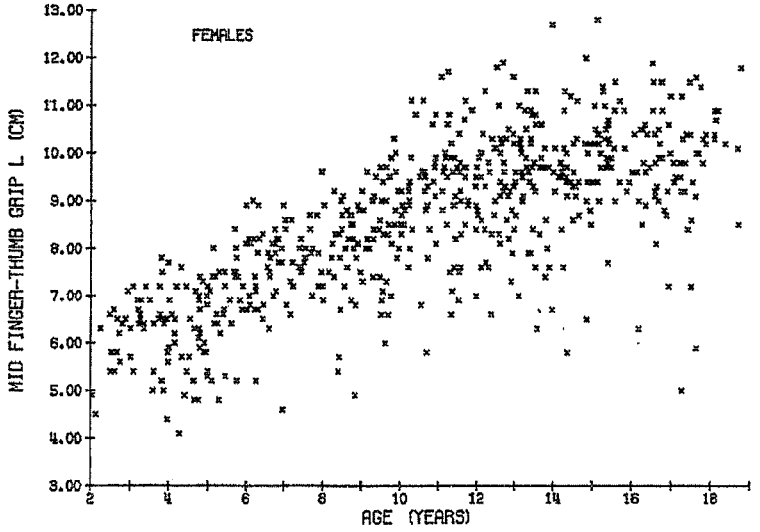

In order to ensure safety and to prevent inadvertent use of a top panel as a wieldable weapon, the openings or cutouts could be designed and located such that a child cannot get a sufficient grip on the panel to wield it like a weapon with only one hand. In order to prevent such behavior, the opening in the small top panels would preferably be a single notch that allows the child to insert a finger to lift the panel upwards, requiring the child to then grasp the edge of the panel between their thumb and forefingers. Because of the relatively small size of the panel, this should allow enough lifting and gripping force to remove the panel and hang it for storage but not enough gripping force to allow the child to wield the panel like a weapon without losing grip on it. Because the panel may be relatively small and light, this is an acceptable design tradeoff favoring a loose grip that should be sufficient for normal removal without frequent drops over a tight grip that prevents drops but allows it to be wielded like a weapon. An alternate preferred opening could be a small hole located at such a distance from the edge as to not allow small children of a particular demographic range to grasp the panel between the thumb and middle finger, as shown in FIG. 19. This opening design would allow easy removal with one or two fingers and enough grip to allow storing the panel by hanging without dropping it in the process, but would prevent a strong enough grip allow it to be wielded like a weapon.

Hinged Cover Panels:

In an alternate embodiment, two or more of the top panels may be attached to one another using one or more hinge mechanisms to prevent removal of an individual panel but allowing the top panels to rotate relative to one another to allow access to the storage compartment underneath. The top panels may be sized appropriately to allow one top panel to fully rotate and fold back on an adjacent panel as shown in FIGS. 29-40. It should be understood that the hinge mechanism could be one or more individual hinges, a piano hinge, or even a thin sheet of material or coating such as leather, vinyl or flexible plastic adhered to coplanar panel surfaces to form a hinge between the panels. In addition, panels formed from cut or molded plastic could be produced with a "living hinge" between the sections. In addition, hinges with a resistance mechanism like a laptop computer screen hinge that allows the panels to fold over onto one another slowly so that fingers aren't crushed.

In an alternate embodiment, a top panel may be hingedly attached to allow the top panel to fold over the top edge of a side panel through approximately 270 degrees of motion and rest against the side of the table. This embodiment has the advantage that the top panel cannot be separated from the table, preventing it from being misplaced and eliminating the extra step of manually lifting and positioning the panel on cover panel hangers for storage. It should be understood that the hinge mechanism could be implemented in a variety of ways, such as using individual hinges, a piano hinge, a thin sheet of material or coating such as leather, vinyl or flexible plastic adhered to adjacent panel surfaces to form a hinge between the panels, or a mechanism as shown in FIGS. 46-49.

Storage Compartment Bottom and Liners:

In an alternate embodiment, a tray or insert made from a material such as plastic, cloth or netting could be provided to line the storage volume to provide a number of benefits such as providing protection from liquids or oils collecting in the bottom and fouling the material from which the table is made, preventing small pieces, dust and debris from falling through gaps between panels, or simply making it more convenient to remove the contents of the storage volume for transport elsewhere. In an alternate embodiment, a cloth liner with a drawstring could allow a collection of Lego building blocks to be gathered up by simply pulling the drawstring tight and lifting them out to take on a trip.

In an alternate embodiment, the bottom of the storage volume could be produced by one or more removable trays or inserts such that the trays or inserts could be easily removed for cleaning, transport or storing elsewhere. This embodiment might help to reduce costs by utilizing a more cheaply produced tray or insert, or utilizing an off-the-shelf part that is readily available.

In an alternate embodiment, the bottom of the storage volume could be produced from a mesh material that would allow liquids, dirt, dust and small debris to fall through while still containing the items being stored. This alternate embodiment would help to keep dirt and debris out of small Lego building blocks by allowing it to fall through to the surface below.

Figure 34:
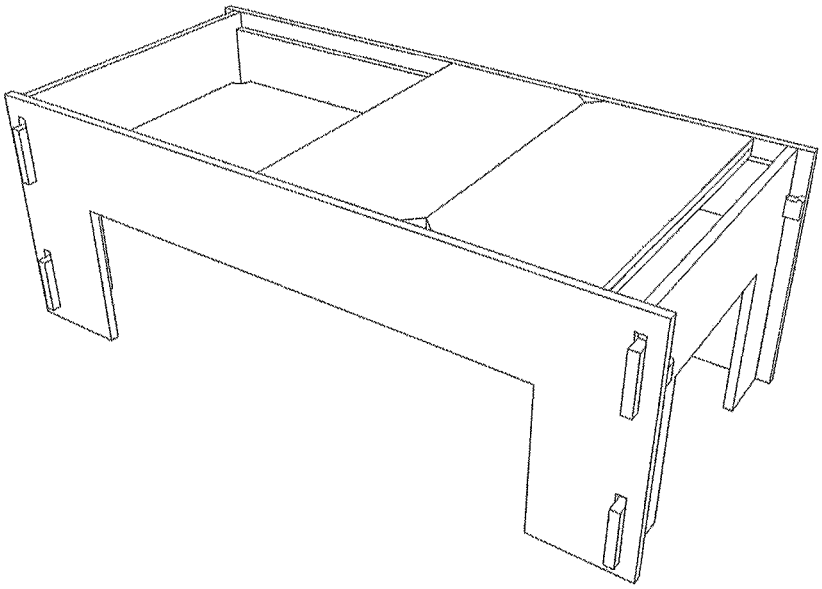
FIG. 34—Table design of FIG. 29 with small top panels hinged open fully and the top panels translated along the supporting rails toward one side of the table.
Figure 35:
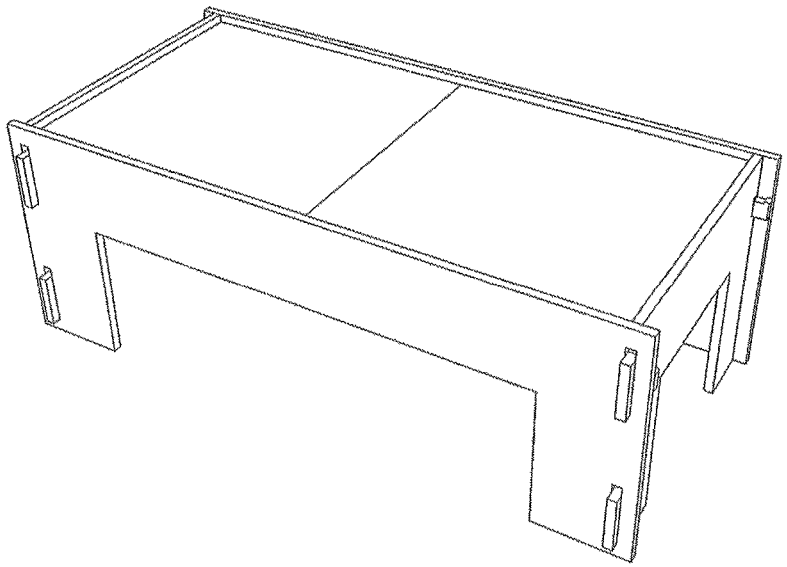
FIG. 35—Alternate embodiment illustrating two hinged top panels.
Figure 36:
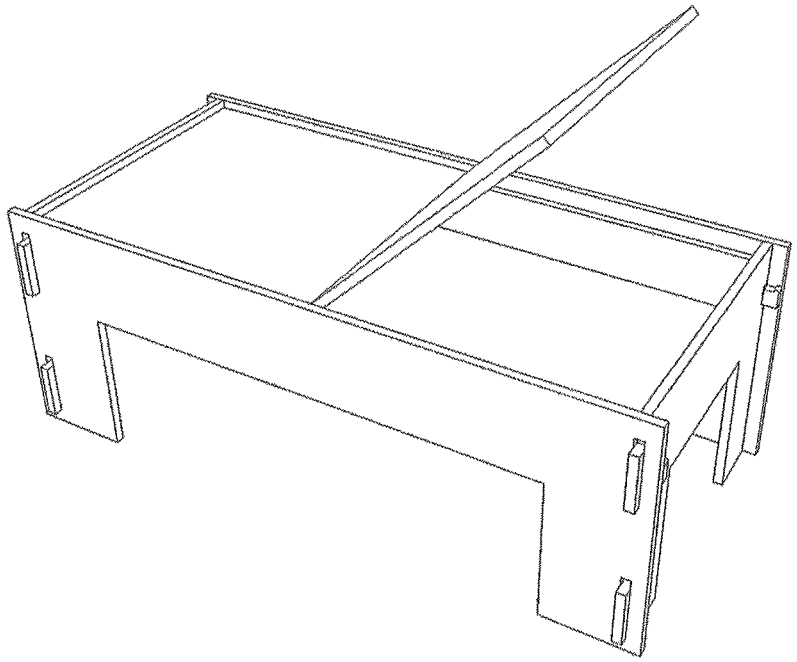
FIG. 36—Alternate embodiment of FIG. 35 with one top, panel hinged open 45 degrees.
Figure 37:
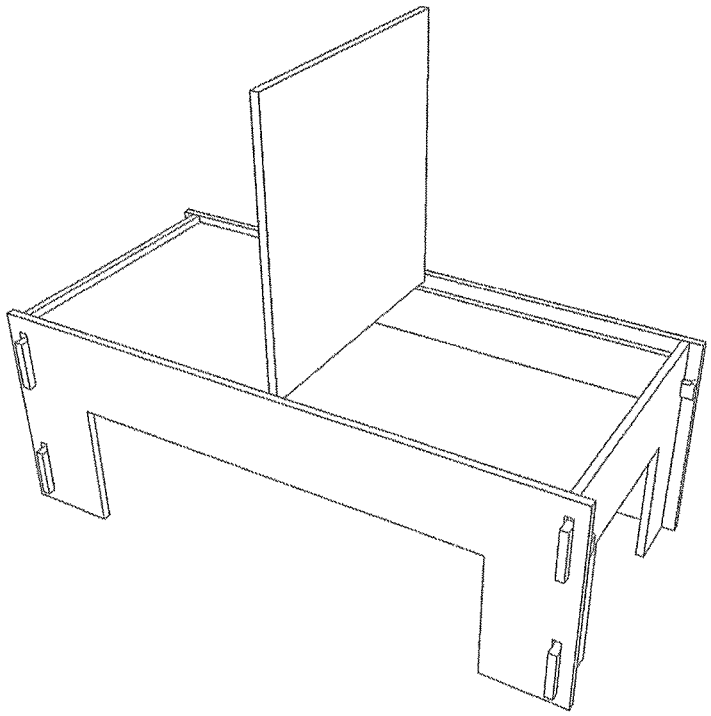
FIG. 37—Alternate embodiment of FIG. 35 with one top panel hinged open 90 degrees.
Figure 38:
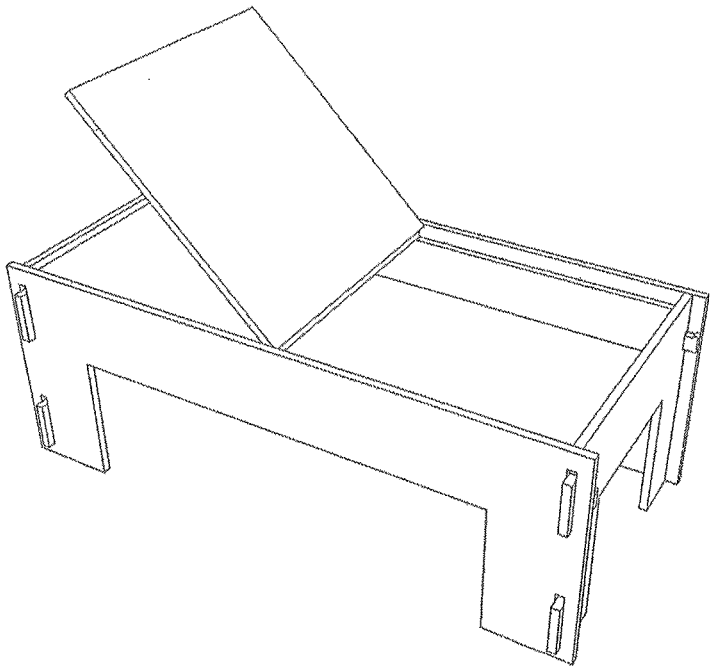
FIG. 38—Alternate embodiment of FIG. 35 with one top panel hinged open 135 degrees.
Figure 39:
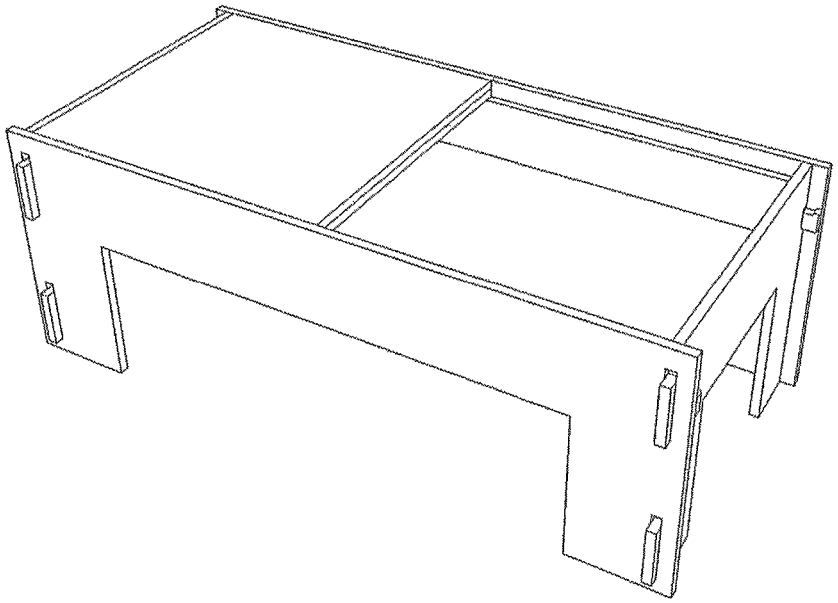
FIG. 39—Alternate embodiment of FIG. 35 with one top panel hinged open fully 180 degrees.
Figure 40:
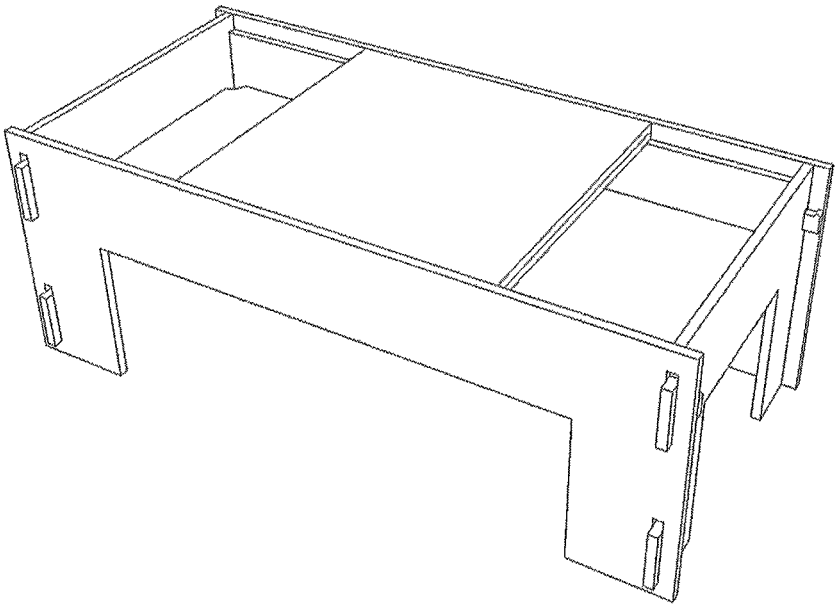
FIG. 40—Alternate embodiment of FIG. 35 with one top panel hinged open fully 180 degrees and top panels translated along the supporting rails toward one side of the table.

In an alternate embodiment, the bottom of the storage volume may contain cutouts or apertures to allow cables and wiring to pass through the panels to reach devices stored within the storage compartment. This would allow convenient charging of a tablet or mobile phone while stored within the storage compartment. FIG. 34 and FIG. 40 show an alternate embodiment illustrating a cutout in the corner of the bottom panel that would allow cabling and wiring to pass through the bottom panel.

In an alternate embodiment, the storage volume may contain one or more dividers to partition the volume into two or more distinct compartments to allow its contents to be separated. Step 16 of the assembly instructions illustrate three panels being slotted together to produce free-standing dividers, and Step 17 of the assembly instructions illustrate these panels being lowered into the volume to divide it into four distinct storage volumes. It should be understood that a divider could be produced by any variety of methods, some examples including free-standing interlocking panels as shown in Step 16-17 of the assembly instructions, a free-standing pre-formed divider such as an injection molded plastic divider, a bent metal divider or a wood divider constructed with traditional wood joinery techniques, a rigid or flexible panel or pre-formed divider that relies on friction or flexure to hold it in place, a rigid or flexible panel or pre-formed divider that relies on adhesives or magnetism to hold it in place, or separate bins or trays placed into the storage compartment.

Cover Panel Recesses and Lego Base Plates:

In an alternate embodiment, one or more top panels may contain a recessed area to receive a game board such as but not limited to a chess board, checker board, backgammon board, Chinese checkers board, a Lego building block base plate or a Duplo building block base plate. The recessed area prevents the boards or base plates from sliding around during normal use and play.

In an alternate embodiment, one or more top panels may be pre-textured on one or both sides to receive items such as Lego building blocks or game pieces.

Figure 2:
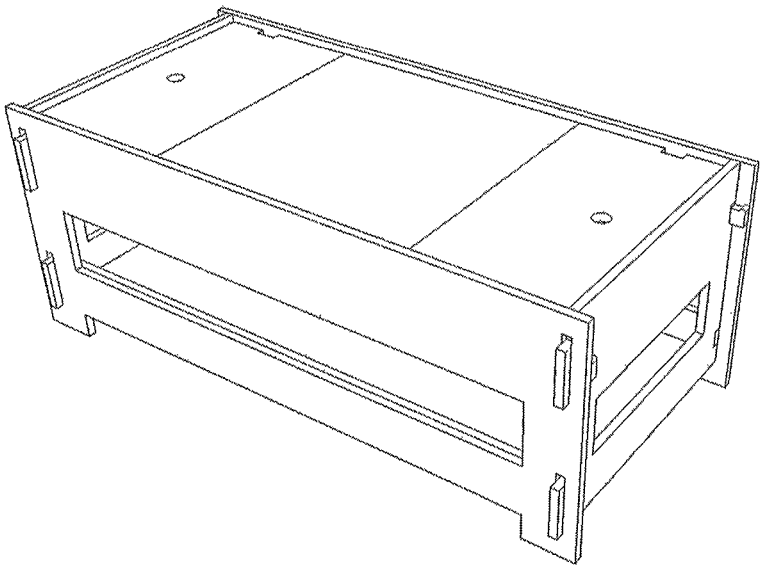
FIG. 2—Alternate table design with storage volume located under three removable top panels and with additional storage shelf located below.
Figure 3:
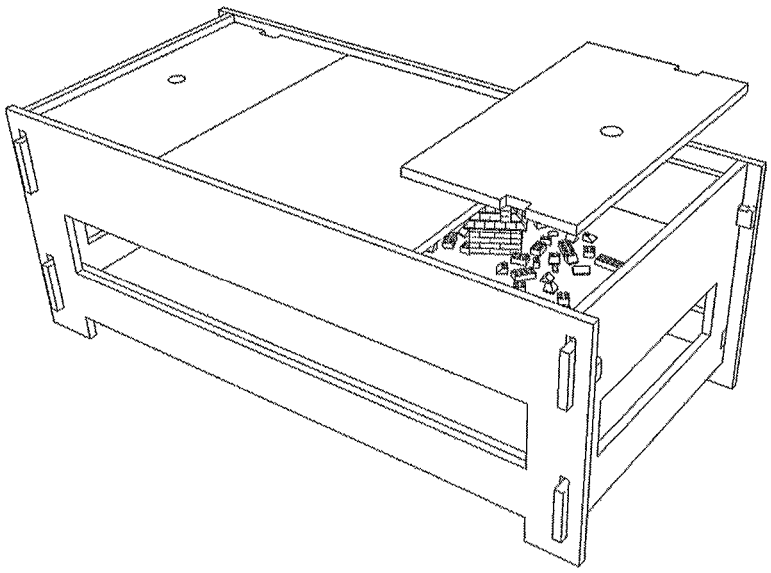
FIG. 3—Table design of FIG. 2 shown with one small top panel being removed.
Figure 4:
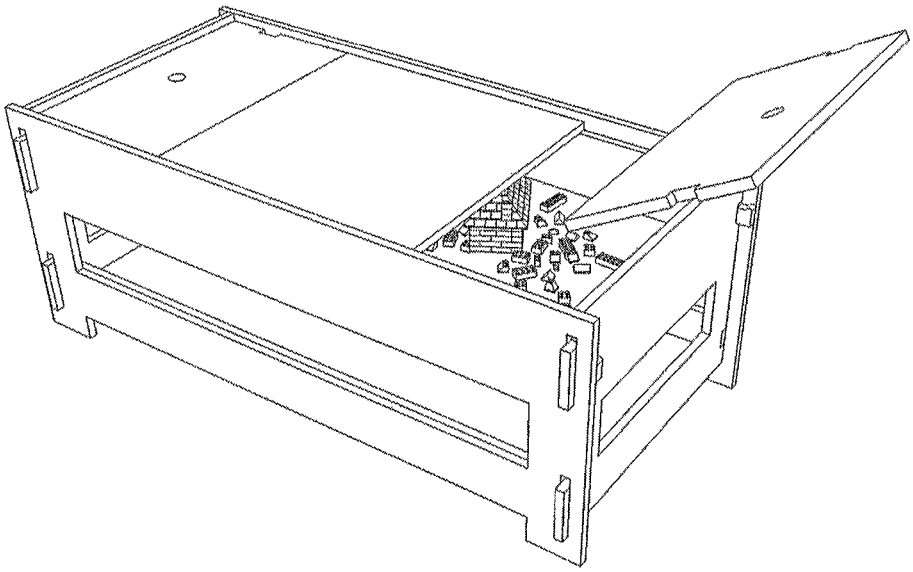
FIG. 4—Table design of FIG. 3 shown with small top panel being rotated so that it may be stored on the table's side hangers.
Figure 5:
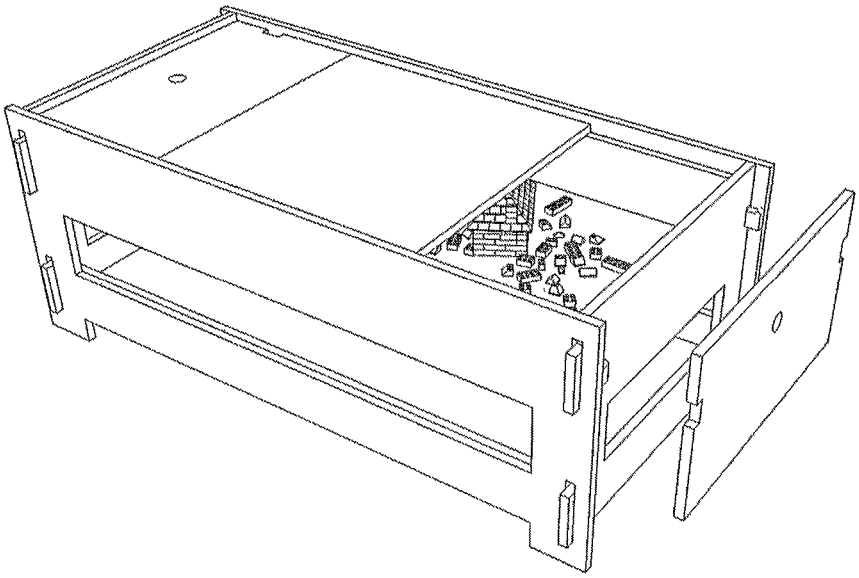
FIG. 5—Table design of FIG. 4 shown with small top panel about to be stored on the table's side hangers.
Figure 6:
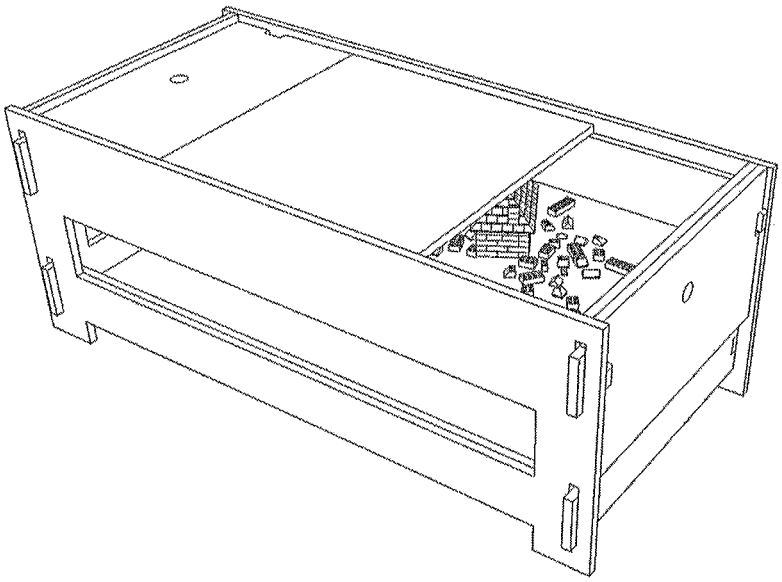
FIG. 6—Table design of FIG. 5 shown with small top panel in stored position, supported by the hangers on the side of the table.
Figure 7:
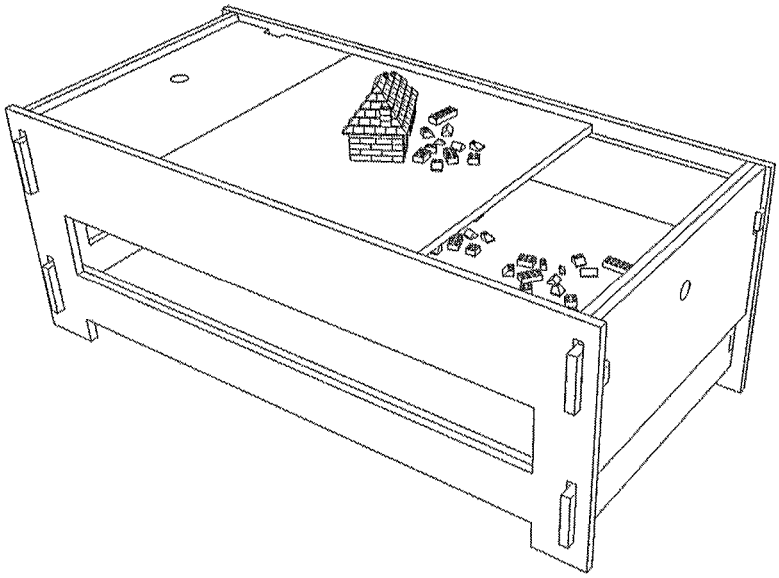
FIG. 7—Table design of FIG. 6 shown with some building blocks removed and placed on the middle top panel.
Figure 8:
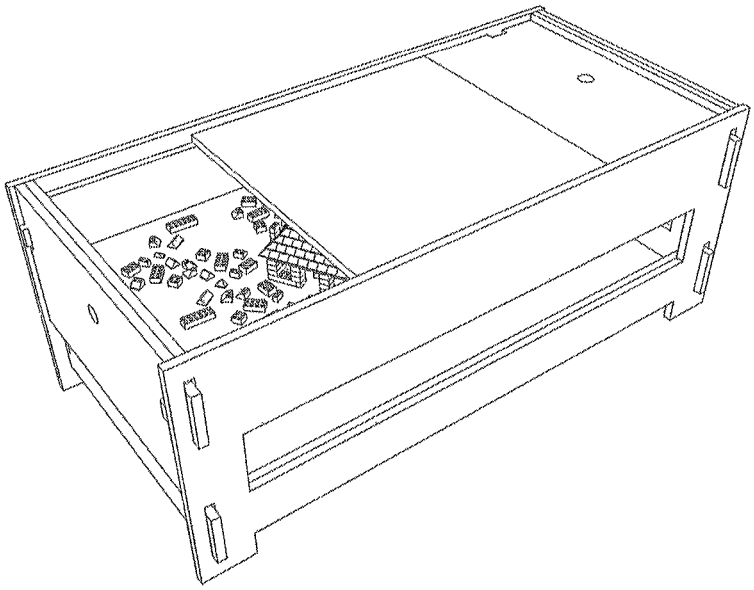
FIG. 8—Table design of FIG. 2 shown with one small top panel removed.
Figure 9:
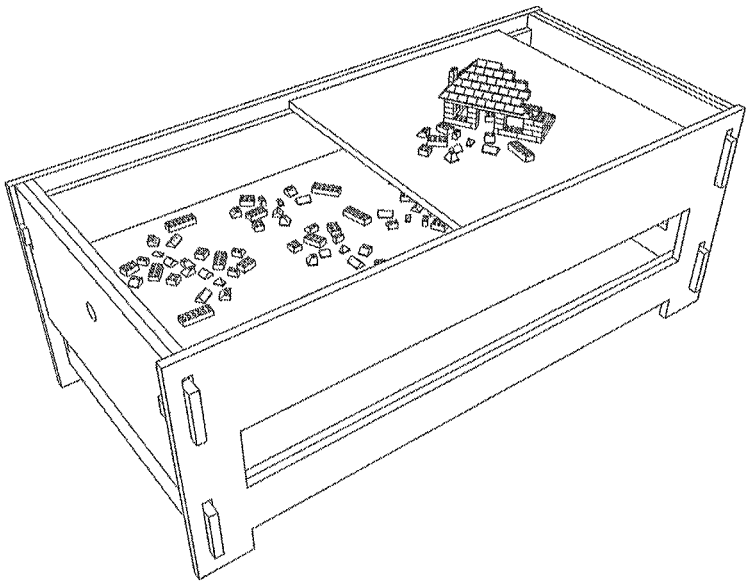
FIG. 9—Table design of FIG. 2 shown with both small top panels removed and the middle top panel translated along the support rails to allow better access to one side of the storage volume underneath.
Figure 10:
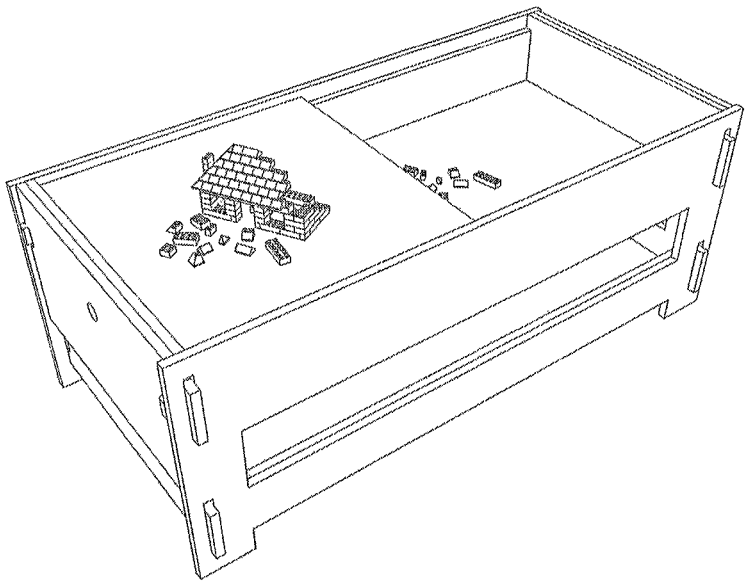
FIG. 10—Table design of FIG. 2 shown with both small top panels removed and the middle top panel translated along the support rails to allow better access to the opposite side of the storage volume.
Figure 11:
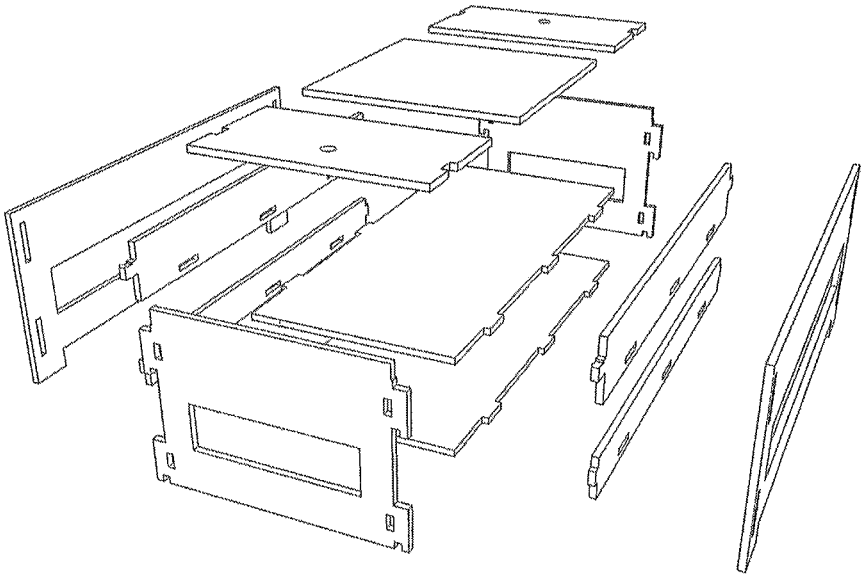
FIG. 11—Table design of FIG. 2 disassembled and shown with all panels in an exploded state.
Figure 12:
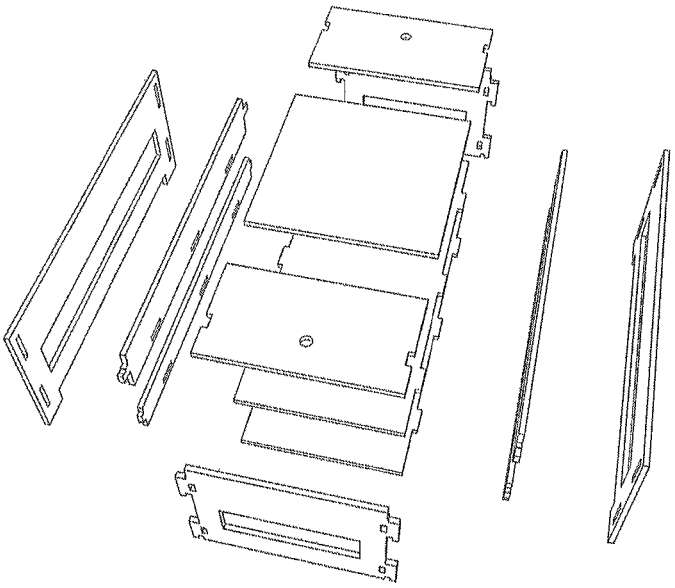
FIG. 12—Alternate view of the table design of FIG. 2 disassembled and shown with all panels in an exploded state.
Figure 13:
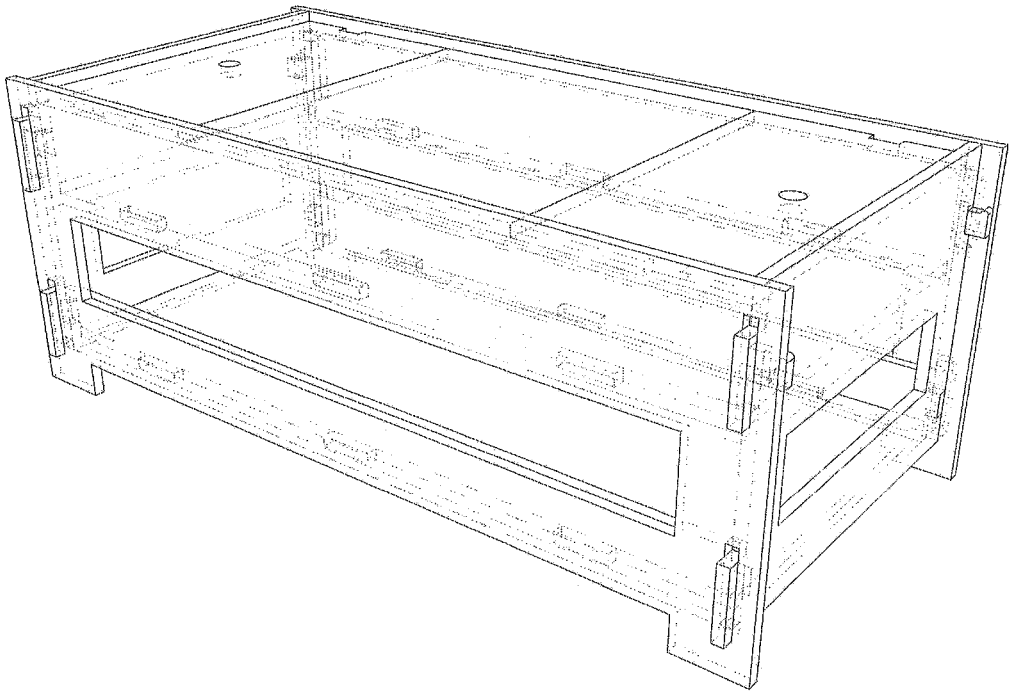
FIG. 13—Hidden line view of assembled table design of FIG. 2 with concealed storage volume above and open storage area below.
Figure 50:
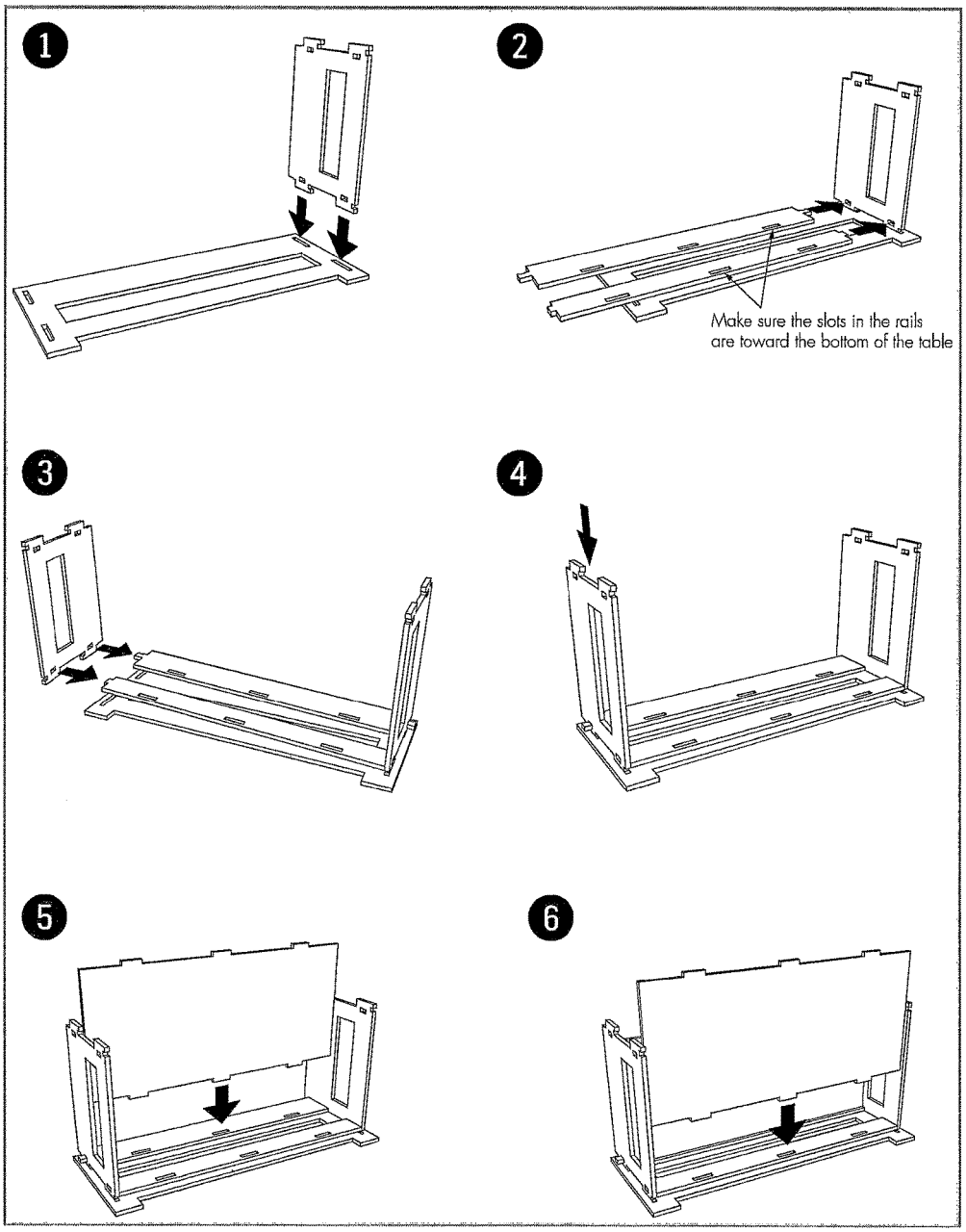
FIG. 50—A first page of the assembly instructions for the alternate embodiment of FIG. 2.
Figure 51:
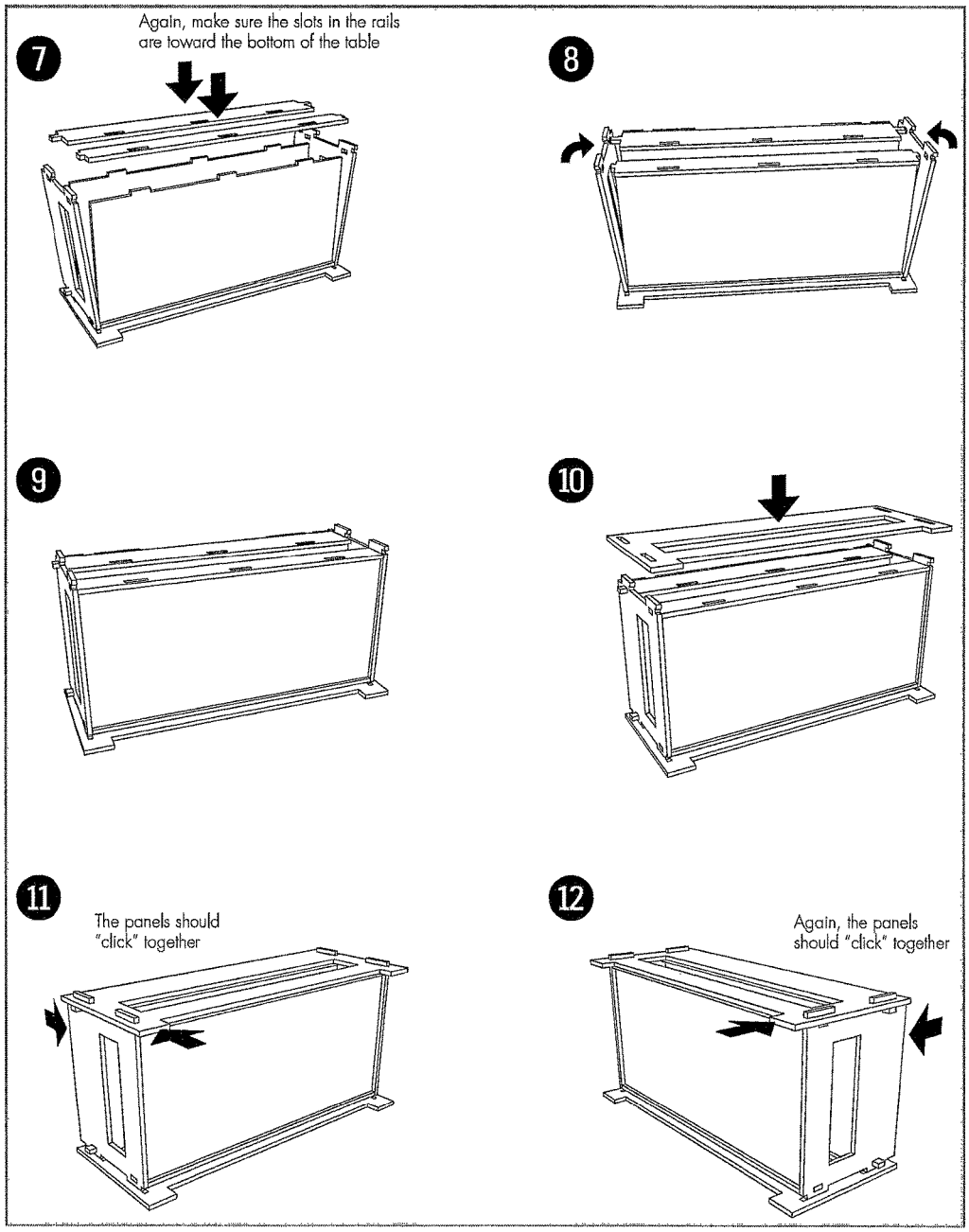
FIG. 51—A second page of the assembly instructions for the alternate embodiment of FIG. 2.
Figure 52:
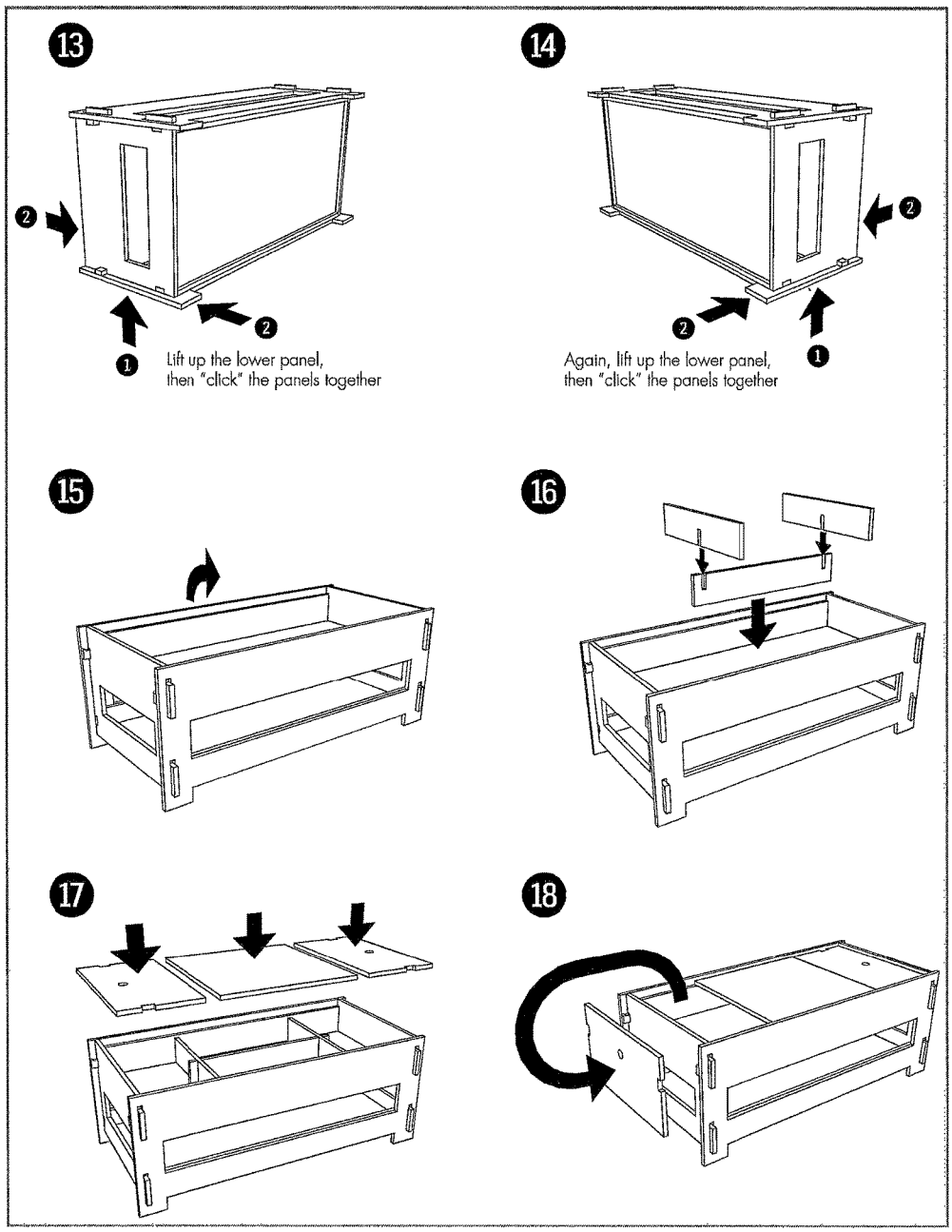
FIG. 52—A third page of the assembly instructions for the alternate embodiment of FIG. 2.

Tool-Free Embodiments:

An alternate embodiment of the device of the present application shown in FIG. 2 may be assembled by hand without the need for any tools or hardware. FIGS. 50-52 illustrate the assembly of the alternate embodiment of the device of the present invention shown in FIG. 2. Some panels shown in FIGS. 50-52 utilize slot and tab joinery where an L-shaped tab on one panel is inserted into a slot in a mating panel, then urged sideways into a final, locked position. A panel may utilize a locking bump to prevent the L-shaped tab from easily being disengaged from the mating panel by relying on the flexure of the mating panel to provide resistance against the L-shaped tab being urged sideways. This makes the joint more securely by resisting or preventing disassembly, depending on the design and dimensions of the locking bump. Utilizing this locking bump on one or more panels may make the article of furniture more solid and resist or prevent disassembly should the article be lifted, tilted or turned upside-down.

Alternate embodiments of the device of the present application may be made tool-free using a variety of commercially available fastening mechanisms, and are not limited to the tab-and-slot assembly method shown in FIGS. 50-52.

Planar Materials:

The alternate embodiments of the device of the present invention shown in FIGS. 1-18 and FIGS. 23-49 allow but do not require all components to be planar in design. A planar component eliminates the need for any final construction or assembly to be performed after the component is machined and before it is packaged, minimizing the amount of material handling and number of machining operations that are required to manufacture it. Planar final components can be produced from raw planar material in one machining step. It is also possible to utilize materials that are either pre-finished, such as melamine-coated plywoods, or materials that require no finish to be applied, such as plastics, to further reduce the number of steps required for manufacture. Reducing material handling and machining operations can help to minimize the total cost of manufacture.

The planar design of components makes manufacture suitable to two-axis machining processes such as computer-numerical-control (CNC) routers or CNC laser cutting or CNC water jet cutting.

Figure 14:
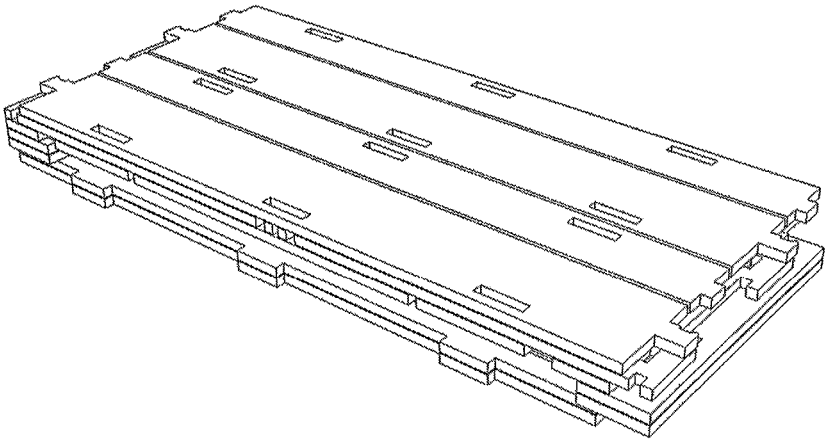
FIG. 14—Disassembled table design of FIG. 2 with all panels shown in a tightly stacked orientation suitable for packaging for shipment to a customer.
Figure 15:
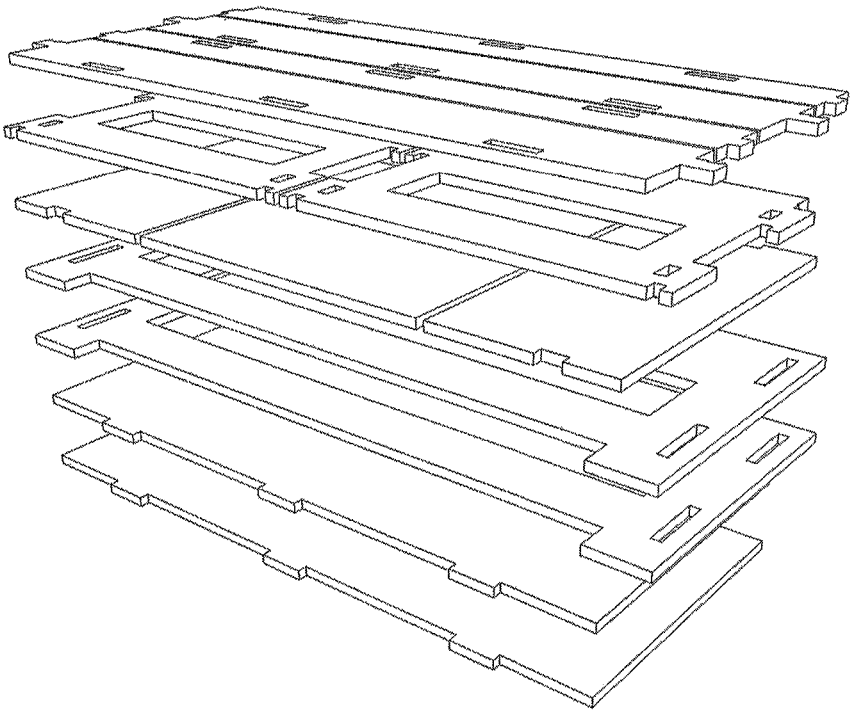
FIG. 15—All table panels of FIG. 14 shown in an exploded view to better illustrate the orientation of the panels in each stack layer.
Figure 16:
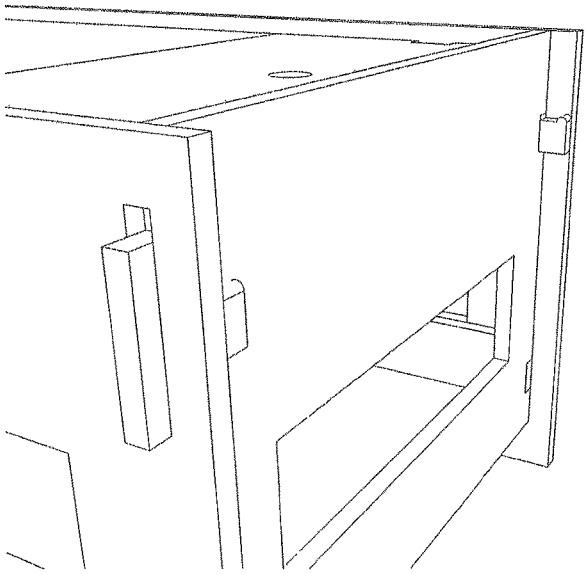
FIG. 16—Detail showing a side view of one of the top panel hangers located on the side of the table design of FIG. 2.
Figure 17:
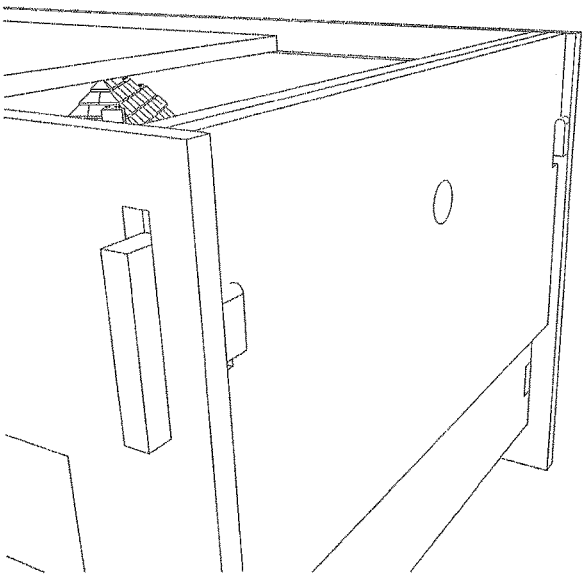
FIG. 17—Detail showing one of the top panels removed and being supported by the top panel hangers on the side of the table design of FIG. 2.

As shown in FIG. 14, planar components may be packed and shipped in a flat configuration. This minimizes the total size of the shipping package and allows use of a wider range of freight carriers for transport and shipping.

Planar pieces allow for more compact storage by the user when disassembled because there is very little wasted space when the panels are stacked closely together. This allows a user to disassemble an article of furniture and store it in a narrow space such as under a bed or against a wall in a closet.

The use of planar material increases the choices of available and suitable construction materials. Plywood sheets, plastic sheets, phenolic sheets, cardboard and even metal sheets are some examples of suitable materials.

Use of planar material minimizes the number of different machining processes required for manufacture. All component pieces may be manufactured using the same machining and finishing processes.

Figure 23:
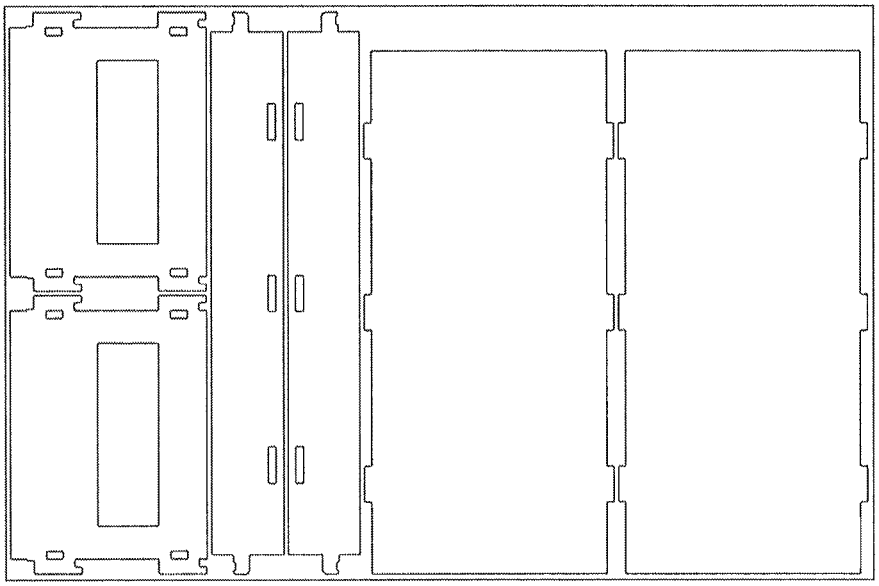
FIG. 23—Panel layout 1 of 2 illustrating how panels nest together on a raw material sheet 4 ft wide×6 ft long.
Figure 24:
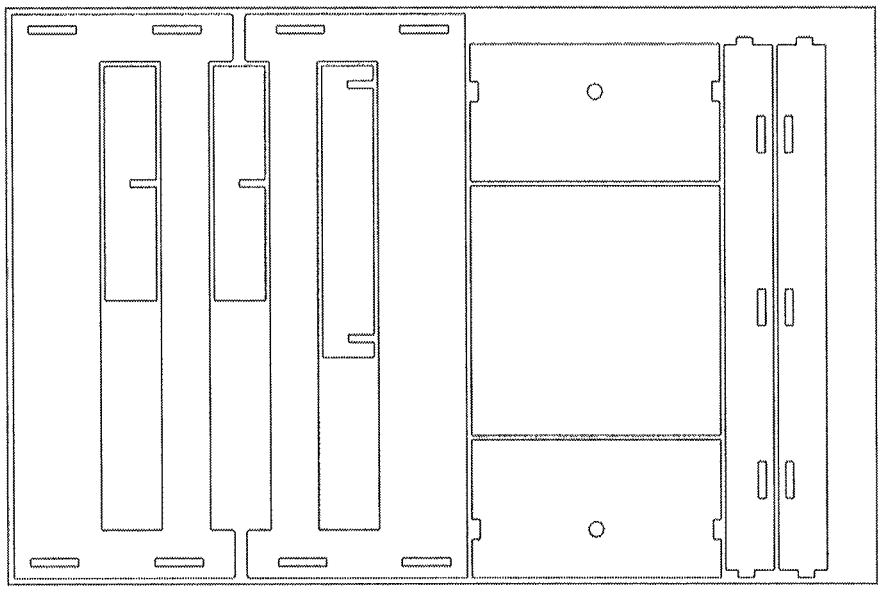
FIG. 24—Panel layout 1 of 2 illustrating how panels nest together on a raw material sheet 4 ft wide×6 ft long.

The device of the present application may be fabricated entirely from planar material of a single thickness. Using a single thickness of material allows all of the panels to be cut from the same material, so parts may be ganged-up on the same raw material sheet for efficiency. FIGS. 23-24 illustrate geometry used to produce CNC router tool paths, demonstrating how the various panels may nest together on the raw material sheets to minimize waste and maximize a CNC machine's usage.

The device of the present application may be fabricated from planar material of differing thicknesses. Individual panels may utilize different thickness materials to achieve different strength characteristics or aesthetics.

The device of the present application may utilize the same material or different materials for each panel. Using the same material for each panel simplifies material procurement, simplifies manufacturing processes and allows taking advantage of economies of scale when purchasing raw material. Allowing different materials for individual panels allows the addition of features based on the chosen material. For example, in an alternate embodiment, one or more panels may be manufactured from glass or acrylic to allow see-through panels, such as the cover panels being manufactured from glass or acrylic to allow an individual to see into the storage compartment without removing the cover panels.

Symmetrical and Asymmetrical Designs:

Symmetrical component pieces may be reversible. This reversibility allows a user to reverse a panel should one become damaged. This reversibility also allows material to be finished differently on opposite sides, allowing the user to choose the appearance of the assembled item by reversing panels during assembly to produce the desired appearance. This reversibility also allows for asymmetrical designs that may be assembled in different configurations. During assembly, the user could position the component pieces in the orientation necessary to produce a specific design. This allows for maximum versatility by adapting to changing usage environments. It allows a user to disassemble a module and reassemble it in a different configuration to meet changing needs.

Both symmetrical and asymmetrical designs are possible. FIGS. 1, 2, 27, 29, 35, 41 and 46 illustrate embodiments that are symmetrical in design. FIGS. 25-26 shown an alternate embodiment with an asymmetric design that incorporates both a low portion and a high portion produced by the asymmetric side panels. This embodiment with an asymmetric design could provide storage areas and surfaces at appropriate heights for young children and older children so that their toys might be kept separate. For example, a lower area would allow younger children to stand and play with large Duplo building blocks, while the higher area would allow older children to stand and play with smaller Lego building blocks that should be kept out of reach of the younger children. This embodiment would be ideal for a family playroom or even a pediatric doctor's waiting room where children of a wide age range might play. Embodiments with asymmetrical designs still allow for maximum utilization of raw material because asymmetrical shapes may be flipped, nested and interlocked on the same raw material sheet to maximize material yield.

I claim:

1. An article of furniture, comprising:

a frame, having a plurality of elements defining a storage volume;

a first rail;

a second rail;

a first panel, the first panel slidingly supported by both the first rail and the second rail;

a second panel, the second panel slidingly supported by both the first rail and the second rail;

a third panel, the third panel slidingly supported by both the first rail and the second rail;

wherein the first, second, and third panels are configured to cover the storage volume; and wherein the plurality of elements of the frame are planar.

2. The article of furniture according to claim 1, wherein the second panel and the third panel are removable.

3. The article of furniture according to claim 2, wherein the second panel is configured for storing adjacent the storage volume.

4. The article of furniture according to claim 3, the second panel comprising:

a first notch; and a second notch;

wherein the first notch is received by the first rail; and wherein the second notch is received by the second rail.

5. The article of furniture according to claim 1, wherein the second panel is hingedly coupled to the first panel; and wherein the third panel is hingedly coupled to the first panel.

6. The article of furniture according to claim 1, wherein the second panel is hingedly coupled to the frame; and wherein the third panel is hingedly coupled to the frame.

7. The article of furniture according to claim 1, the plurality of elements comprising:

a first side panel having;

at least one tab;

a second side panel having;

at least one slot;

wherein a connection between the first side panel and the second side panel is configured such that the tab of the first side panel is inserted into the slot of the second side panel along a first direction, and the tab is moved relative to the slot along a second direction.

8. The article of furniture according to claim 7, wherein the second panel and the third panel are removable.

9. The article of furniture according to claim 8, wherein the second panel is configured for storing adjacent the storage volume.

10. The article of furniture according to claim 9, the second panel, comprising a first notch; and a second notch;

wherein the first notch is received by the first rail; and wherein the second notch is received by the second rail.

11. The article of furniture according to claim 7, wherein the second panel is hingedly coupled to the first panel; and wherein the third panel is hingedly coupled to the first panel.

12. The article of furniture according to claim 7, wherein the second panel is hingedly coupled to the frame; and wherein the third panel is hingedly coupled to the frame.

13. An article of furniture, comprising:

a frame, having a storage volume;

a first rail;

a second rail;

a first panel, the first panel slidingly supported by both the first rail and the second rail;

a second panel, the second panel moveably supported by the frame;

a third panel, the third panel moveably supported by the frame;

wherein the first, second, and third panels are configured to cover the storage volume;

the frame comprising:

a plurality of planar elements configured to be separable and flat packable.

14. The article of furniture according to claim 13, wherein the second panel is hingedly coupled to the frame; and wherein the third panel is hingedly coupled to the frame.

15. The article of furniture according to claim 13, wherein the second panel is slidingly coupled to the frame; and wherein the third panel is slidingly coupled to the frame.

16. The article of furniture according to claim 13, the plurality of planar elements comprising:

a first side panel, having;

at least one tab;

a second side panel, having;

at least one slot;

wherein a connection between the first side panel and the second side panel is configured such that the tab of the first side panel is inserted into the slot of the second side panel along a first direction, and the tab is moved relative to the slot along a second direction.

17. An article of furniture, comprising:

a frame, having;

a storage volume;

a first rail;

a second rail;

a first panel, the first panel slidingly supported by both the first rail and the second rail;

a second panel, the second panel supported by both the first rail and the second rail;

a third panel, the third panel supported by both the first rail and the second rail;

wherein the first, second, and third panels are configured to cover the storage volume;

wherein the second panel is hingedly coupled to the frame; and wherein the third panel is hingedly coupled to the frame;

the frame comprising:

a plurality of planar elements, having;

a first side panel, having;

at least one tab; and a second side panel, having;

at least one slot;

wherein the plurality of planar elements are configured to be separable and flat packable; and wherein a connection between the first side panel and the second side panel is configured such that the tab of the first side panel is inserted into the slot of the second side panel along a first direction, and the tab is moved relative to the slot along a second direction.

* * * * *